US008626053B2

(12) United States Patent
Nishida

(10) Patent No.: US 8,626,053 B2
(45) Date of Patent: Jan. 7, 2014

(54) MEDIUM CORRECTING DEVICE AND IMAGE FORMING DEVICE

(75) Inventor: Haruhiko Nishida, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 393 days.

(21) Appl. No.: 12/797,105

(22) Filed: Jun. 9, 2010

(65) Prior Publication Data

US 2011/0142518 A1 Jun. 16, 2011

(30) Foreign Application Priority Data

Dec. 10, 2009 (JP) ..... 2009-280541

(51) Int. Cl.
*G03G 15/00* (2006.01)
*G03G 21/00* (2006.01)

(52) U.S. Cl.
USPC ..... 399/406; 399/21; 399/124

(58) Field of Classification Search
CPC ..... G03G 15/6576; G03G 2215/0129
USPC ..... 399/21, 406, 124
See application file for complete search history.

(56) References Cited

U.S. PATENT DOCUMENTS

2005/0063747 A1* 3/2005 Ushio ..... 399/406
2007/0003317 A1* 1/2007 Masuda ..... 399/101
2007/0035080 A1* 2/2007 Yamada et al. ..... 270/58.07

FOREIGN PATENT DOCUMENTS

JP 06348164 * 12/1994
JP A-2009-249168 10/2009

* cited by examiner

*Primary Examiner* — Judy Nguyen
*Assistant Examiner* — Blake A Tankersley
(74) *Attorney, Agent, or Firm* — Oliff & Berridge, PLC

(57) ABSTRACT

A medium correcting device includes: a first holding body that holds a first rotating body having a surface moving circumferentially; a second holding body that holds a second rotating body having a surface that moves following the circumferential movement of the first rotating body and becoming a coupled body incorporating the first and second rotating bodies; a rotation shaft connected to a driving system when the coupled body is housed in a housing body and separated from the driving system when the coupled body is removed; an off-center cam eccentrically fixed to the rotation shaft, presses one rotating body against the other by an amount of pressing according to an angle of the off-center cam, the amount being larger in a downward eccentric direction; and a center-of-gravity correction section fixed to the rotation shaft, causing a larger torque than a torque produced by the off-center cam's own gravity.

3 Claims, 30 Drawing Sheets

FIG. 8

| | AMOUNT OF BITING[mm] | SHAFT SPEED SET VALUE A[mm/sec] | | | | | SHAFT SPEED SET VALUE A' AFTER ADJUSTMENT |
|---|---|---|---|---|---|---|---|
| | | 266.5 | 310.0 | 400.0 | 445.0 | 500.0 | |
| | | SHEET CONVEYANCE SPEED[mm/sec] | | | | | |
| Roll #1 | 0.1 | 267.7 | 311.7 | 402.0 | 447.1 | 501.8 | A |
| Roll #2 | 0.6 | 268.6 | 311.9 | 402.7 | 448.2 | 503.3 | 0.9974A |
| Roll #3 | 1.2 | 269.5 | 313.9 | 404.6 | 450.2 | 505.0 | 0.9931A |
| Roll #4 | 1.7 | 270.0 | 314.3 | 405.3 | 450.7 | 505.9 | 0.9919A |
| Roll #5 | 2.2 | 270.3 | 314.4 | 405.5 | 451.0 | 506.1 | 0.9913A |

FIG. 9

| | AMOUNT OF BITING [mm] | SHAFT SPEED SET VALUE B[mm/sec] | | | | | | SHAFT SPEED SET VALUE B' AFTER ADJUSTMENT |
|---|---|---|---|---|---|---|---|---|
| | | 266.5 | 310.0 | 400.0 | 450.0 | 480.0 | 510.0 | |
| | | SHEET CONVEYANCE SPEED[mm/sec] | | | | | | |
| Belt #1 | 2.2 | 248.9 | 290.1 | 374.2 | 420.5 | 448.5 | 476.0 | B |
| Belt #2 | 5.6 | 239.5 | 279.1 | 359.0 | 403.8 | 430.9 | 458.0 | 1.0392B |
| Belt #3 | 7.3 | 232.5 | 271.2 | 349.4 | 392.5 | 418.2 | 445.4 | 1.0676B |

FIG. 10

CONVEYANCE SPEED 448.5

| Roll | Belt | Roll A' | Belt B' |
|---|---|---|---|
| #1 | #1 | 446.6(A) | 480(B) |
| #1 | #2 | ↑ | 498.8(1.0392B) |
| #1 | #3 | ↑ | 512.5(1.0676B) |
| #2 | #1 | 445.4(0.9974A) | 480 |
| #2 | #2 | ↑ | 498.8 |
| #2 | #3 | ↑ | 512.5 |
| #3 | #1 | 443.5(0.9931A) | 480 |
| #3 | #2 | ↑ | 498.8 |
| #3 | #3 | ↑ | 512.5 |
| #4 | #1 | 443(0.9919A) | 480 |
| #4 | #2 | ↑ | 498.8 |
| #4 | #3 | ↑ | 512.5 |
| #5 | #1 | 442.7(0.9913A) | 480 |
| #5 | #2 | ↑ | 498.8 |
| #5 | #3 | ↑ | 512.5 |

MEDIUM CORRECTING DEVICE AND IMAGE FORMING DEVICE

CROSS-REFERENCE TO RELATED APPLICATION

This application is based on and claims priority under 35 USC 119 from Japanese Patent Application No. 2009-280541, filed Dec. 10, 2009.

BACKGROUND (i) Technical Field

The present invention relates to a medium correcting device and an image forming device.

(ii) Related Art

Conventionally, there is known a curl correction device that corrects a curl produced on a paper sheet.

SUMMARY

According to an aspect of the invention, there is provided a medium correcting device including:

a first rotating body that has a circumferential surface moving circumferentially;

a second rotating body that has a circumferential surface softer than the circumferential surface of the first rotating body and moving circumferentially as the circumferential surface of the first rotating body moves circumferentially while the circumferential surface of the second rotating body and the circumferential surface of the first rotating body press each other, the second rotating body and the first rotating body holding a recording medium passing in between;

a first holding body that holds the first rotating body;

a second holding body that holds the second rotating body, is detachably coupled to the first holding body, and becomes, when being coupled to the first holding body, a coupled body into which the first rotating body and the second rotating body are incorporated and which is housed in a housing body;

a rotation shaft that is incorporated as a part of the coupled body and driven to rotate by a driving system of the housing body when the coupled body is housed in the housing body and the rotation shaft is connected to the driving system, the rotation shaft being disconnected and away from the driving system when the coupled body is removed from the housing body;

an off-center cam that is eccentrically fixed to the rotation shaft, presses one of the first rotating body and the second rotating body against the other by an amount of pressing according to an angle of the off-center cam, the angle of the off-center cam providing a larger amount of pressing when having a downward eccentric direction than when having an upward eccentric direction; and a center-of-gravity correction section that is fixed to the rotation shaft and deviates a center of gravity in a direction opposite to a direction in which the off-center cam is eccentric, the center-of-gravity correction section causing a torque larger than a torque produced in the rotation shaft by the off-center cam.

BRIEF DESCRIPTION OF THE DRAWINGS

Exemplary embodiments of the present invention will be described in detail based on the following figures, wherein:

FIG. 8 illustrates the contents in the graph depicted in FIG. 6 in the form of a list;

FIG. 9 illustrates the contents in the graph depicted in FIG. 7 in the form of a list;

FIG. 10 is a diagram that illustrates a relationship between the amount of biting and the shaft speed set value in each of the roll decurler section and the belt decurler section;

DETAILED DESCRIPTION

An exemplary embodiment of the invention will be described below with reference to the drawings.

Figure 1:
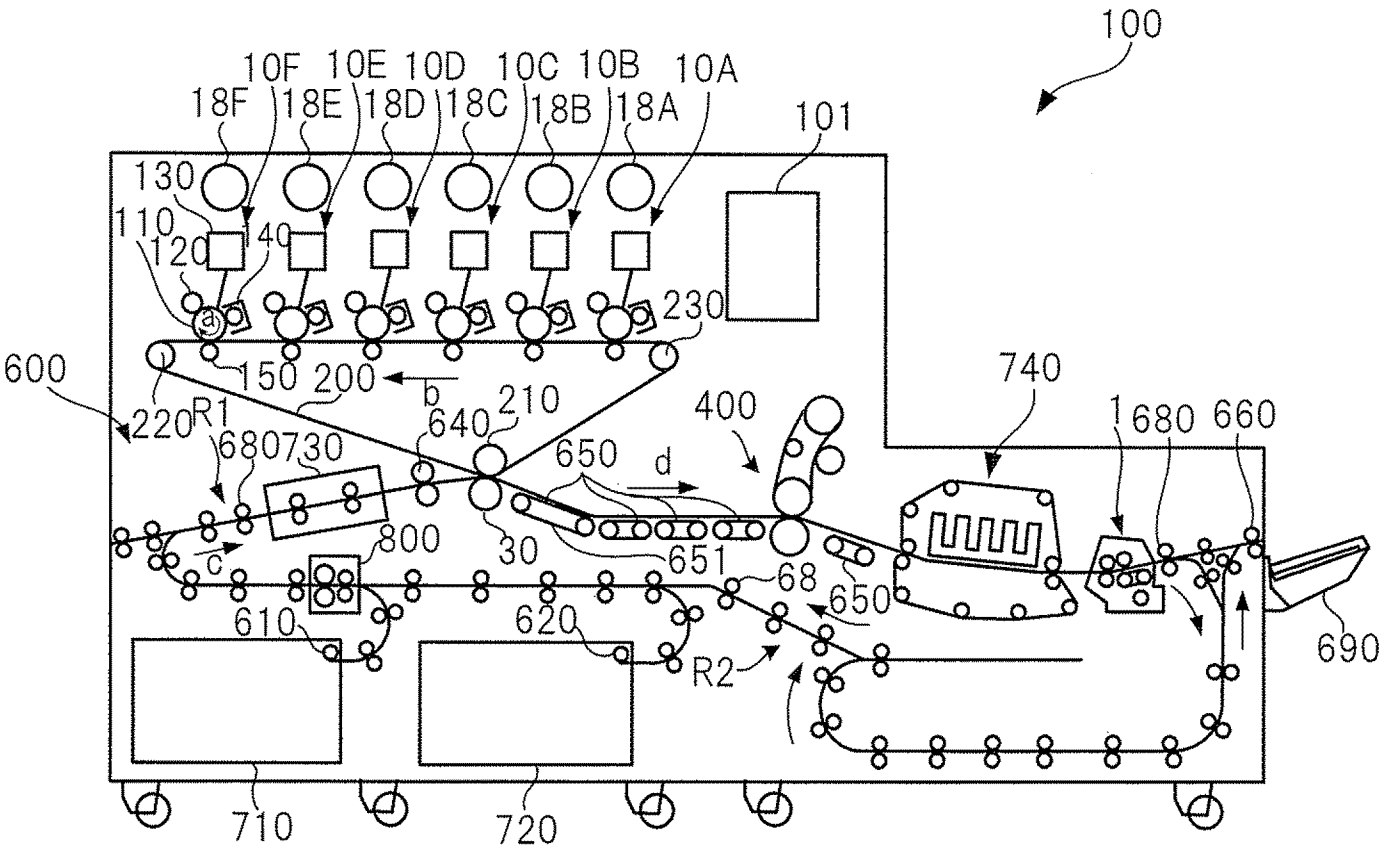
FIG. 1 is a schematic structural diagram of an image forming device.

FIG. 1 is a schematic structural diagram of an image forming device.

An image forming device 100 illustrated in FIG. 1 forms an electrostatic latent image on the surface of a photoreceptor, forms a toner image by developing the electrostatic latent image with a toner, and finally transfers the toner image to a paper sheet and fixes the transferred toner image, thereby forming the fixed toner image on the paper sheet. Incidentally, this image forming device 100 accepts not only a paper recording medium but a resinous recording medium represented by an OHP sheet. However, the following description will be provided by using the paper recording medium as a representative example unless otherwise specified.

Further, the image forming device 100 is a tandem type of color printer in which six image forming sections 10A, 10B, 100, 10D, 10E and 10F that respectively form images of mutually different colors are disposed in parallel. The image forming device 100 is capable of printing a single-colored image in a single-color mode and a color image formed by toner images of plural colors in a full-color mode. For example, among the six image forming sections 10A through 10F, the four image forming sections 100, 10D, 10E and 10F correspond to yellow (Y), magenta (M), cyan (C) and black (K), respectively, and the remaining two image forming sections 10A and 10B correspond to special colors except these YMCK colors. The special colors include, for example, colors that are not easy to precisely express by the combination of YMCK, such as a color that represents a particular company, pastel colors, and transparent colors for luster. The image forming device 100 includes six toner cartridges 18A, 18B, 18C, 18D, 18E and 18F that contain toners of the colors corresponding to the image forming sections 10A through 10F, respectively. Furthermore, the image forming device 100 has, in addition to a single-sided printing mode that is a default setting, a double-sided printing mode. The image forming device 100 is an exemplary embodiment of the image forming device according to an aspect of the present invention.

Since the six image forming sections 10A through 10F have similar structures, the image forming section 10F corresponding to black will be described as representing these six image forming sections.

The image forming section 10F includes a photoreceptor 110, a charging device 120 that charges the surface of the photoreceptor 110, an exposure device 130 that irradiates the photoreceptor 110 with exposure light based on an image signal supplied externally, a developing device 140 that develops the surface of the photoreceptor 110 with a toner, and a primary transfer device 150 that transfers the toner image to an intermediate transfer belt 200. The photoreceptor 110 has a surface in the shape of a cylinder and rotates in the direction of an arrow "a" around an axis of the cylinder.

Further, the image forming device 100 includes the intermediate transfer belt 200 to which the toner image is transferred from the photoreceptor 110 of each of the image forming sections 10A through 10F, a secondary transfer device 300 that transfers the toner image from the intermediate transfer belt 200 to a paper sheet, a fixing device 400 that fixes the toner on the paper sheet, a decurler device 1 that corrects a curl of the paper sheet, and a paper conveyance section 600 that conveys the paper sheet. Furthermore, the image forming device 100 includes paper containers 710 and 720 that contain the paper sheet (s), a deburring device 800 that removes burrs of the paper sheet before image formation, a posture correcting section 730 that corrects the posture of the paper sheet, a cooling device 740 that cools the paper sheet after the toner image is fixed, an output paper container 690 that receives the paper sheet after the image formation by the image forming device 100 is completed, and a main-unit controller 101 that controls each section of the image forming device 100. Incidentally, the image forming device 100 has a conveyance course R1 along which an image is formed on the surface of a paper sheet being conveyed and a front-and-back inversion course R2 along which the paper sheet with one side where the toner image is fixed is turned upside down.

The intermediate transfer belt 200 is a belt-shaped endless member supported by belt support rolls 210, 220 and 230, and circulates in the direction of an arrow "b" that passes by the image forming sections 10A through 10F and the secondary transfer device 300 in this order.

The paper conveyance section 600 includes drawing rolls 610 and 620 that draw paper sheets from the paper containers 710 and 720, respectively, a registration roll 640 that sends each of the paper sheets to the secondary transfer device 300 in timing for the transfer of the toner image by the secondary transfer device 300, sucking conveyance devices 650 that convey the paper sheet from the secondary transfer device 300 to the fixing device 400 while making the paper sheet cling to the outer surfaces of conveyance belts 651, an output roll 660 that outputs the paper sheet to the outside of the image forming device 100, and conveyance rolls 680 that are respectively disposed along the conveyance course R1 and the front-and-back inversion course R2 and convey the paper sheets.

The paper conveyance section 600 conveys the paper sheet from each of the paper containers 710 and 720 along the conveyance course R1 passing through the deburring device 800, the posture correcting section 730, the secondary transfer device 300, the fixing device 400, the cooling device 740 and the decurler device 1 sequentially. When a double-sided printing is executed, the paper conveyance section 600 conveys the paper sheet along the front-and-back inversion course R2 diverging from the conveyance course R1 and returning to the conveyance course R1. The paper sheet, which has one side where the toner image is fixed while passing through the conveyance course R1, is turned upside down while passing through the front-and-back inversion course R2. The paper sheet after being turned upside down returns to the conveyance course R1, subsequently passes through the deburring device 800 and the posture correcting section 730 again, and the toner image is transferred by the secondary transfer device 300 to the reverse side of the paper sheet, namely the side to which the toner image is yet to be transferred.

A basic operation of the image forming device 100 illustrated in FIG. 1 will be described. The description will be provided by taking a mode in which an image of black (K) is formed by the corresponding image forming section 10F as an example of the single-color mode. The photoreceptor 110 is driven to rotate in the direction of the arrow "a", and a charge is applied to the surface of the photoreceptor 110 by the charging device 120. The exposure device 130 forms an electrostatic latent image on the surface of the photoreceptor 110 by irradiating the photoreceptor 110 with exposure light based on an image signal supplied externally. To be more specific, the exposure device 130 forms the electrostatic latent image on the surface of the photoreceptor 110 by emitting the exposure light based on data corresponding to black in the image signal. The developing device 140 forms a toner image on the surface of the photoreceptor 110 by developing the electrostatic latent image with a black toner. The developing device 140 of the image forming section 10F is supplied with the toner by the toner cartridge 18F. The photoreceptor 110 retains the toner image upon formation of the toner image. The toner image formed on the surface of the photoreceptor 110 is transferred to the intermediate transfer belt 200 by the primary transfer device 150.

Meanwhile, the paper sheets in the paper containers 710 and 720 are taken out by the drawing rolls 610 and 620, and then conveyed along the conveyance course R1 in the direction of an arrow "c" by the conveyance roll 680 and the registration roll 640 toward the secondary transfer device 300. As for the paper sheet conveyed toward the secondary transfer device 300, burr at an edge of the paper sheet is removed by the deburring device 800 disposed in the conveyance course R1. After the deburring by the deburring device 800, the posture and position of the paper sheet is corrected by the posture correcting section 730.

The secondary transfer device 300 transfers the toner image on the intermediate transfer belt 200 to the paper sheet by causing, between the intermediate transfer belt 200 and the paper sheet, a potential difference for transfer. The paper sheet to which the toner image is transferred is conveyed in the direction of an arrow "d" by the conveyance belts 651, and then the toner image is fixed on the surface of the paper sheet by the fixing device 400. In this way, an image is formed on the paper sheet. The fixing device 400 has a heating belt to raise thermal capacity. The paper sheet with the surface where the image is formed is cooled by the cooling device 740, and then a curl of the paper sheet is corrected by the decurler device 1. Subsequently, the paper sheet is output by the output roll 660 and is laid in the output paper container 690.

In the full-color mode, the five image forming sections 10A through 10E corresponding to the colors except black operate like the image forming section 10F corresponding to black, and thereby toner images corresponding to the respective colors are formed. In the image forming sections 10A through 10F, image formation and transfer timing is adjusted so that the toner images formed on the respective photoreceptor surfaces are superimposed while being transferred to the intermediate transfer belt 200.

In the double-sided printing mode, the paper conveyance section 600 conveys, along the front-and-back inversion course R2, a paper sheet after an image is fixed to one side of the paper sheet and a curl is corrected while the paper sheet is conveyed along the conveyance course R1. Subsequently, the paper conveyance section 600 turns the paper sheet upside down and then conveys the paper sheet along the conveyance course R1 again during which the image is fixed to the other side of the paper sheet and a curl is corrected. This is an outline of the image formation movements in the image forming device 100.

Next, the decurler device 1 will be described.

Figure 2:
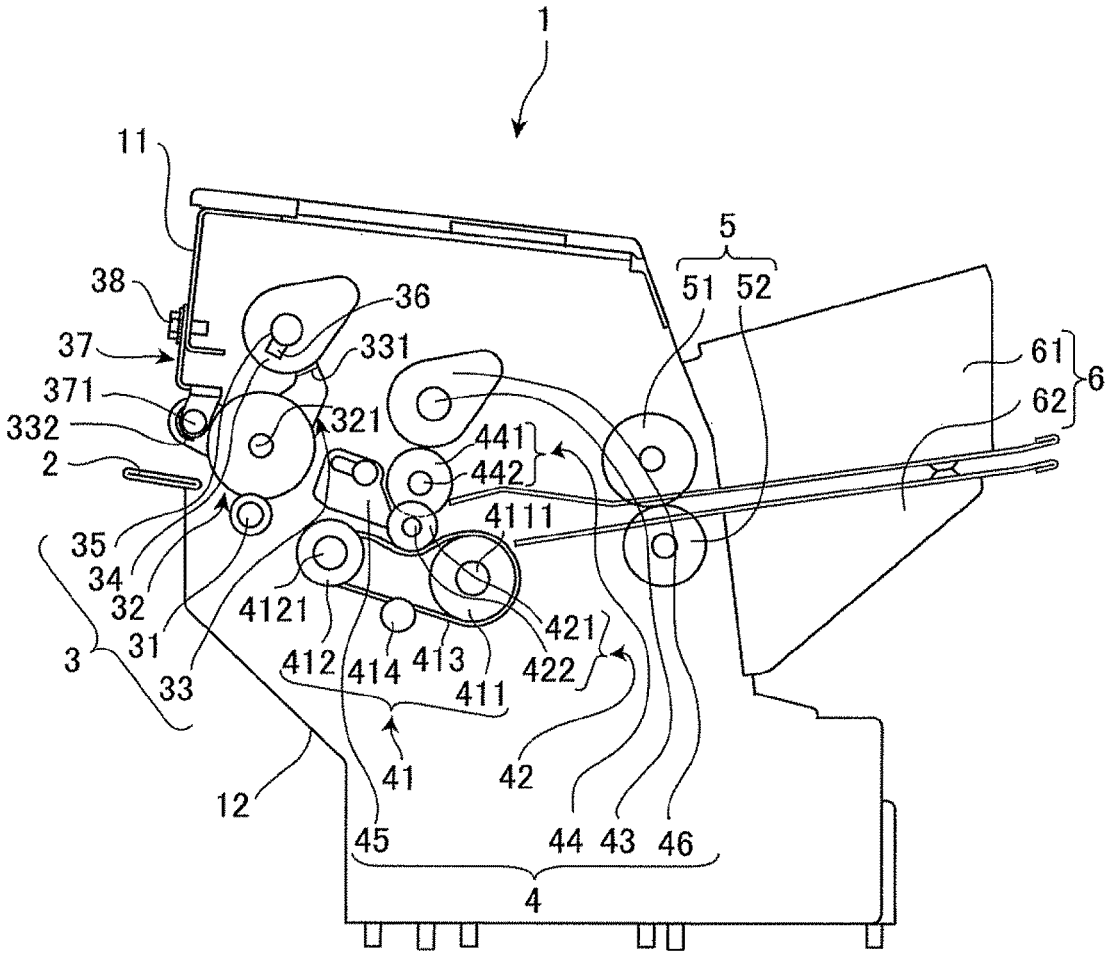
FIG. 2 is a perspective diagram of a decurler device when viewed from a side.

FIG. 2 is a perspective diagram of the decurler device when viewed from a side.

The decurler device 1 illustrated in FIG. 2 includes: a receiving chute 2 that receives the paper sheet that has passed through the cooling device 740, a roll decurler section 3 that corrects a curl of the paper sheet, a belt decurler section 4 disposed downstream from the roll decurler section 3 in a sheet conveyance direction, a conveyance roll section 5 that conveys the paper sheet after the curl is corrected, and an output chute section 6 that outputs the paper sheet from the decurler device 1.

The roll decurler section 3 includes a conveyance drive shaft 31 that is driven to rotate thereby conveying the paper sheet sent from the receiving chute 2, a correction roll 32 that corrects a curl of the paper sheet held between the correction roll 32 and the conveyance drive shaft 31, and a first holding member 33 that holds both ends of an arbor 321 of the correction roll 32 for the purpose of allowing the correction roll 32 to freely rotate. The roll decurler section 3 further includes a first off-center cam 34 that touches one end 331 of the first holding member 33, and a first rotating shaft 35 to which the first off-center cam 34 is fixed and which is connected to a rotating shaft of a stepping motor provided in the main unit side of the image forming device 100. The first holding member 33 is allowed to change the posture within a predetermined range. The decurler device 1 is an exemplary embodiment of the medium correction device.

The roll decurler section 3 further includes a weight 36 attached to the first rotating shaft 35, and a first support member 37 that supports the first holding member 33 while allowing the posture of the first holding member 33 to change in the predetermined range. In the roll decurler section 3, the first holding member 33, the first off-center cam 34 and the first support member 37 are each provided in a pair.

The surface of the correction roll 32 is softer than the conveyance drive shaft 31, and the correction roll 32 rotates following the conveyance drive shaft 31. As the posture of the first holding member 33 changes, the amount of biting of the conveyance drive shaft 31 into the correction roll 32 changes.

The first holding member 33 is a resin molded member having a thickness of around 5 mm. One end of the first holding member 33 is provided with a contact section 331 contacting the first off-center cam 34, and the other end is provided with a through hole 332 formed along a direction in which the correction roll 32 extends. Further, the first holding member 33 holds both ends of the arbor 321 of the correction roll 32 for the purpose of allowing the correction roll 32 to freely rotate in a central part.

The first rotating shaft 35 is rotatably supported by a frontward housing part and a rearward housing part of an upper housing 11 illustrated in FIG. 2. Also, the first off-center cam 34 is eccentrically fixed at a position on an inner side of a supported part of the first rotating shaft 35 supported by each of the frontward and rearward housing parts of the upper housing 11. This position corresponds to the contact section 331 of the first holding member 33. Further, the first rotating shaft 35 is coupled to the stepping motor provided in the main unit side of the image forming device 100, through a coupler fixed further outwardly than the rearward housing part of the upper housing 11 illustrated in FIG. 2. Incidentally, the weight 36 attached to the first rotating shaft 35 will be described later.

Although details will be described later, the first support member 37 is a metal member having, at one end, a penetrating shaft 371 passing through the through hole 332 of the first holding member 33, and the other end is fixed to the upper housing 11 by a screw 38. Each tip of the penetrating shaft 371 passing through the through hole 332 is inserted into a hole formed in each of the frontward housing part and the rearward housing part illustrated in FIG. 2 of the upper housing 11.

When the stepping motor provided in the main unit side is driven for only the specified number of steps, the first rotating shaft 35 coupled to this stepping motor rotates by only a rotation angle according to the specified number of steps. As a result, the posture of the first off-center cam 34 eccentrically fixed to the first rotating shaft 35 changes.

Since the contact section 331 of the first holding member 33 is in contact with the first off-center cam 34, the first holding member 33 is caused to rotate around the penetrating shaft 371 passing through the through hole 332 by the change in the posture of the first off-center cam 34. As the posture, which centers on the penetrating shaft 371, of the first holding member 33 changes, the amount of biting of the conveyance drive shaft 31 into the correction roll 32 held by the first holding member 33 varies. When the amount of biting of the conveyance drive shaft 31 into the correction roll 32 changes, correction intensity with respect to the paper sheet passing between the correction roll 32 and the conveyance drive shaft 31 changes.

The roll decurler section 3 serves to correct the posture of the paper sheet conveyed in the conveyance course R1, i.e. to correct the paper sheet curling up at both ends. The more the amount of biting of the conveyance drive shaft 31 into the correction roll 32 is, the stronger the degree of correcting the curl of the paper sheet passing between the correction roll 32 and the conveyance drive shaft 31 is. On the other hand, the less the amount of biting of the conveyance drive shaft 31 into the correction roll 32 is, the weaker the degree of correcting the curl of the paper sheet passing between the correction roll 32 and the conveyance drive shaft 31 is. This roll decurler section is an example of the correction section, and the conveyance drive shaft 31 and the correction roll 32 are examples of the rod-like rotation body. The correction roll 32 is an example of the rotating body.

The belt decurler section 4 includes a belt unit 41 that conveys the paper sheet, a pressing member 42 that presses the paper sheet against the belt unit 41, a paper conveyance guide 45 that guides the conveyance of the paper sheet, and a second off-center cam 46 that adjusts the press of the paper sheet against the belt unit 41 by the pressing member 42. The belt decurler section 4 further includes a second rotating shaft 43 to which the second off-center cam 46 is fixed and whose end part is connected to the rotating shaft of a stepping motor provided in the main unit side of the image forming device 100, and an intermediate member 44 that touches both the second off-center cam 46 and the pressing member 42.

The belt unit 41 includes a rotational drive roll 411 that is driven to rotate, a suspension roll 412 that is rotatable, an endless belt 413 held by the rotational drive roll 411 and the suspension roll 412, and a tension roll 414 that provides the endless belt 413 with tension. The rotational drive roll 411 has an arbor 4111 in the center, and the arbor 4111 is rotatably supported by a frontward housing part and a rearward housing part, illustrated in FIG. 2, of the upper housing 11. Further, a coupler is attached to the arbor 4111 at a point further rearward than a part supported by the rearward housing part. The arbor 4111 is coupled to a rotary motor provided in the main unit side of the image forming device 100 via this coupler.

Like the first rotating shaft 35, the second rotating shaft 43 is rotatably supported by a frontward housing part and a rearward housing part, illustrated in FIG. 2, of the upper housing 11. The second off-center cam 46 is fixed slightly further inward than parts supported by the frontward housing part and the rearward housing part illustrated in FIG. 2. The second rotating shaft 43 is coupled to the stepping motor provided in the main unit side of the image forming device 100, via a coupler fixed further outwardly than the rearward housing part.

The intermediate member 44 includes a disc member 441 contacting the second off-center cam 46, and a first moving shaft 442 penetrating the center of the disc member 441. The disc member 441 is fixed to both ends of the first moving shaft 442. Because the disc member 441 is in contact with the second off-center cam 46, the first moving shaft 442 moves up and down in a predetermined range according to a change in the posture of the second off-center cam 46.

The pressing member 42 includes a second moving shaft 422 with both ends contacting the disc member 441, and a pressing roll 421 contacting the endless belt 413. The second moving shaft 422 serves as an arbor of the pressing roll 421. Because the disc member 441 of the intermediate member 44 and the second moving shaft 422 are in contact with each other, the pressing member 42 moves up and down in a predetermined range while following the motion of the intermediate member 44.

Both ends of the paper conveyance guide 45 are connected to both edges of the second moving shaft 422, and the posture of the paper conveyance guide 45 changes according to the up-and-down motion of the second moving shaft 422. Since the posture of the paper conveyance guide 45 changes according to the up-and-down motion of the second moving shaft 422, smooth conveyance of the paper sheet is ensured.

When the stepping motor provided in the main unit side is driven for only the specified number of steps, the second rotating shaft 43 coupled to this stepping motor rotates by only a rotation angle according to the specified number of steps. As a result, the posture of the second off-center cam 46 eccentrically fixed to the second rotating shaft 43 changes.

As for the intermediate member 44, the first moving shaft 442 moves up and down according to the posture of the second off-center cam 46. The second moving shaft 422 also moves up and down following the up-and-down motion of the first moving shaft 442, and the amount of biting of the pressing roll 421 into the endless belt 413 changes. When the amount of biting of the second moving shaft 422 into the endless belt 413 changes, correction intensity with respect to the paper sheet passing between the endless belt 413 and the second moving shaft 422 changes.

The belt decurler section 4 serves to correct the paper sheet being conveyed in the conveyance course R1, i.e. to correct the paper sheet curling down at both ends. The more the amount of biting of the pressing roll 421 into the endless belt 413 is, the stronger the degree of correcting the curl of the paper sheet passing between the endless belt 413 and the pressing roll 421 is. On the other hand, the less the amount of biting of the pressing roll 421 into the endless belt 413 is, the weaker the degree of correcting the curl of the paper sheet passing between the endless belt 413 and the pressing roll 421 is. This belt decurler section 4 is an example of the correction section. The belt unit 41 is an example of each of the rotating body, the rotating body having plural circumferential surfaces, and the rotating body having the belt member. Each endless belt 413 is an example of the belt member. Further, each outer circumferential surface of each endless belt 413 is an example of the circumferential surface that circumferentially moves.

The conveyance roll section 5 has an upper rotating roll 51 and a lower rotating roll 52 that send the paper sheet to the output section 6 by rotating while holding in between the paper sheet after the curl is corrected.

The output section 6 has an upper chute 61 and a lower chute 62, and outputs the paper sheet sent from the conveyance roll section 5 from the decurler device 1 to the outside. The upper chute 61 is attached to the upper housing 11, while the lower chute 62 is attached to a lower housing 12.

Incidentally, although details will be described later, the decurler device 1 is divided into an upper section and a lower section, at the conveyance path serving as a border and also, an end of the upper section and an end of the lower section are connected to each other for the purpose of allowing the upper section to be openable and closable relative to the lower section.

Figure 3:
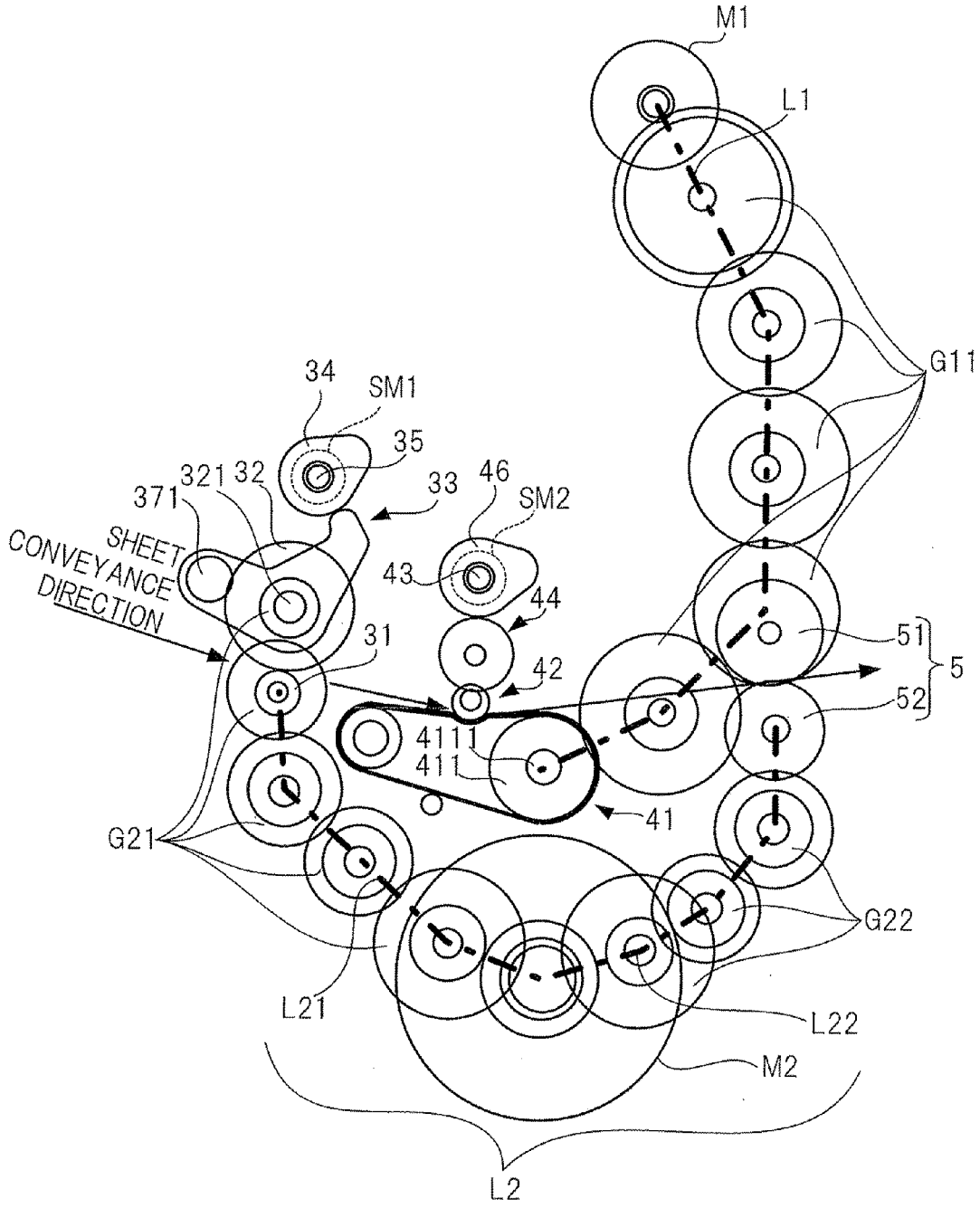
FIG. 3 is a diagram that illustrates a power system of the decurler device.

FIG. 3 is a diagram that illustrates a power system of the decurler device.

FIG. 3 illustrates two systems into which the power system is roughly divided: a main drive system L1 whose drive source is a main motor M1 provided in the main unit side of the image forming device 100, and a local drive system L2 whose drive source is a local motor M2 provided in the decurler device 1.

The main drive system L1 includes the main motor M1 illustrated in an upper part of FIG. 3, a transmission gear group G11, and the arbor 4111 of the rotational drive roll 411 in the belt unit 41.

The local drive system L2 includes: a first local drive system L21 that transmits a rotational driving force of the local motor M2 illustrated in a lower part of FIG. 3 to the conveyance drive shaft 31 of the roll decurler section 3; and a second local drive system L22 that transmits the rotational driving force to the lower rotating roll 52 of the conveyance roll section 5.

The first local drive system L21 is configured by the local motor M2, a transmission gear group G21 and the conveyance drive shaft 31, whereas the second local drive system L22 is configured by the local motor M2, a transmission gear group G22 and the lower rotating roll 52. Each of the local motor M2 and the main motor M1 is an example of the drive source.

FIG. 3 also illustrates: a first stepping motor SM1 that supplies the rotational driving force to the first rotating shaft 35 of the roll decurler section 3 and is provided in the main unit side of the image forming device 100; and a second stepping motor SM2 that supplies the rotational driving force to the second rotating shaft of the belt decurler section 4 and is provided in the main unit side of the image forming device 100.

Figure 4:
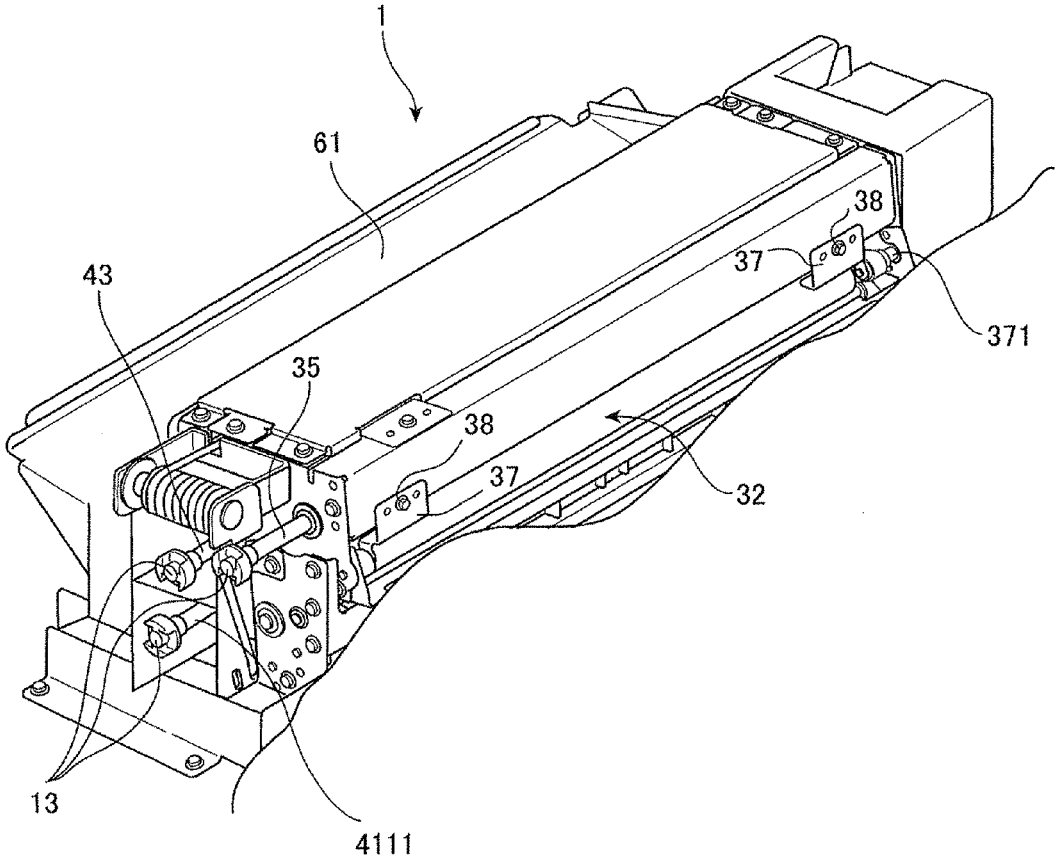
FIG. 4 is an external perspective view of the decurler device when viewed obliquely from above.

FIG. 4 is an external perspective view of the decurler device when viewed obliquely from above.

FIG. 4 also illustrates the other side of the side illustrated in FIG. 2 of the decurler device 1.

On the other side illustrated in FIG. 4, opposite to the side illustrated in FIG. 2, couplers 13 in the form of screws are illustrated. The couplers 13 are respectively attached to an edge of the first rotating shaft 35 of the roll decurler section 3, an edge of the second rotating shaft 43 of the belt decurler section 4, and an edge of the arbor 4111 of the rotational drive roll 411 in the belt decurler section 4, which are illustrated in this order from the top.

As described above, the decurler device 1 is capable of being drawn from a main housing of the image forming device 100 for removing the paper sheet at the time of occurrence of a jam or for replacing a consumable component. Therefore, in the decurler device 1, the couplers 13 shaped like screws are attached to the first rotating shaft 35, the second rotating shaft 43 and the arbor 4111 to which the rotational driving forces are transmitted from the main motor M1, the first stepping motor SM1, the second stepping motor SM2 and the like provided in the main unit side of the body the image forming device 100, and couplers to be engaged with the couplers 13 are attached to the rotating shaft of each motor in the main unit and the shaft of the transmission gear. This structure enables the driving force from the drive source provided in the main unit side to be transmitted to the decurler device 1 capable of being drawn from the main housing.

Here, in the decurler device 1, a drive source of the conveyance drive shaft 31 of the roll decurler section 3 and a drive source of the rotational drive roll 411 of the belt decurler section 4 are provided separately. There will be described below the reason why the drive source of the roll decurler section 3 and the drive source of the belt decurler section 4 are separately provided.

Figure 5:
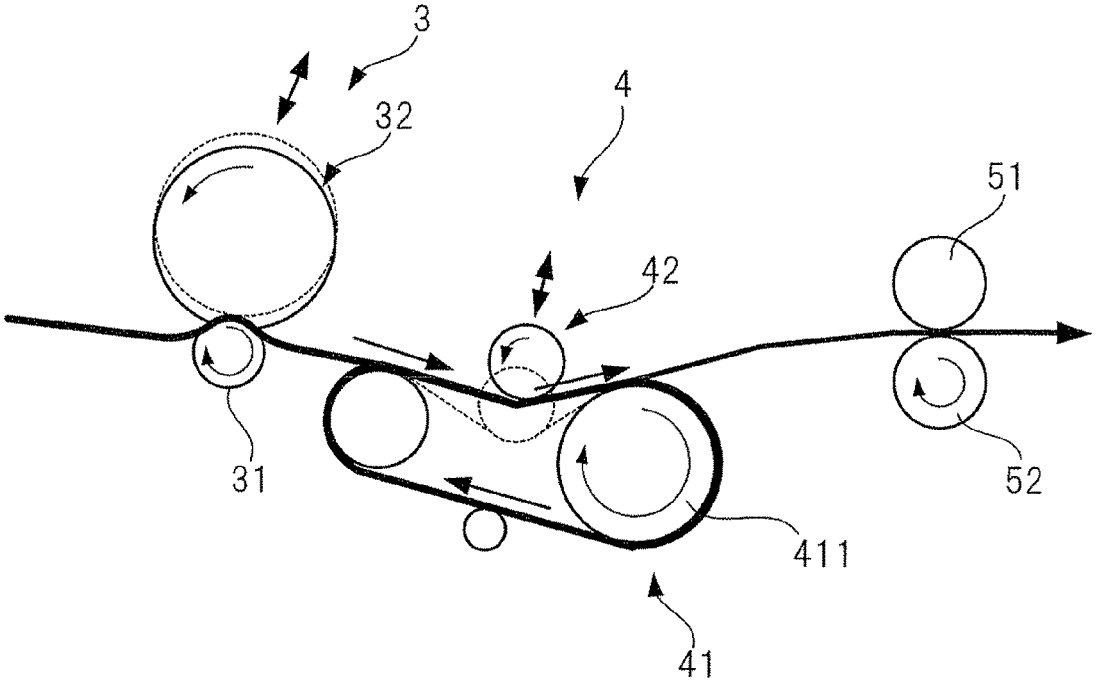
FIG. 5 is a schematic structural diagram of a roll decurler section and a belt decurler section.

FIG. 5 is a schematic structural diagram of the roll decurler section and the belt decurler section.

FIG. 5 illustrates a state in which the correction roll 32 of the roll decurler section 3 and the pressing member 42 of the belt decurler section 4 are movable in the directions indicated by arrows. In FIG. 5, there is indicated, by a solid line, a state of correcting a curl by the roll decurler section 3, namely, a state of correcting the paper sheet curling up at both ends, by softening the curl. There is also indicated, by a dotted line, a state of correcting a curl by the roll decurler section 3, namely, a state of correcting the paper sheet curling down at both ends, by softening the curl.

Figure 6:
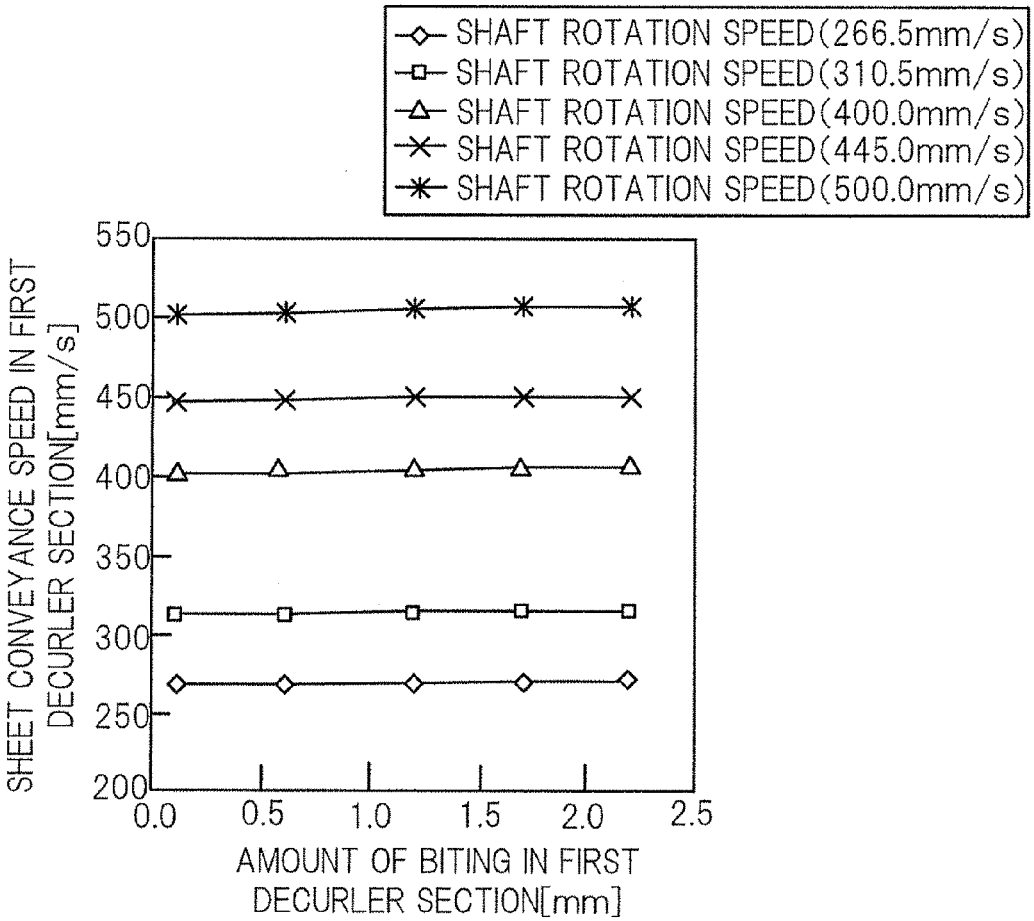
FIG. 6 illustrates a graph of a relationship between the amount of biting and the sheet conveyance speed in the roll decurler section.

FIG. 6 illustrates a graph of a relationship between the amount of biting and the sheet conveyance speed in the roll decurler section.

FIG. 6 illustrates an influence of changing the amount of biting of the conveyance drive shaft 31 into the correction roll 32 on the sheet conveyance speed, when the rotational speed of the conveyance drive shaft 31 of the roll decurler section 3 is set as each of 266.5 mm/sec, 310.0 mm/sec, 400.0 mm/sec, 445.0 mm/sec, and 500.0 mm/sec.

It is found from FIG. 6 that the sheet conveyance speed increases linearly as the amount of biting increases, regardless of whether the rotational speed of the conveyance drive shaft 31 is high or low. Even when the shaft rotational speeds are the same, the sheet conveyance speed in a case in which the amount of biting is large is higher than that in a case in which the amount of biting is small. This is conceivably because a gripping strength of the conveyance drive shaft 31 with respect to the paper sheet is increased by the increase of the amount of biting, preventing the conveyance drive shaft 31 from slipping on the paper sheet.

Figure 7:
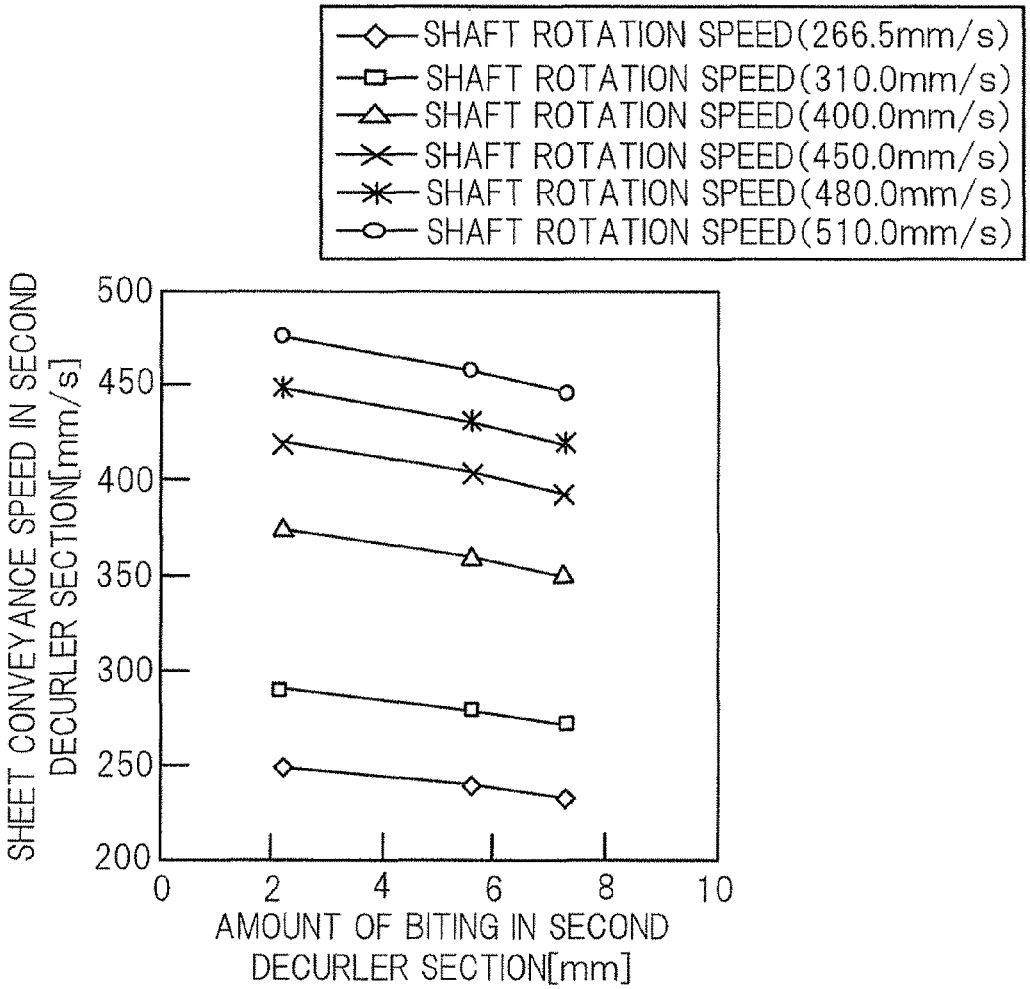
FIG. 7 illustrates a graph of a relationship between the amount of biting and the sheet conveyance speed in the belt decurler section.

On the other hand, FIG. 7 illustrates a graph of a relationship between the amount of biting and the sheet conveyance speed in the belt decurler section.

FIG. 7 illustrates an influence of changing the amount of biting of the pressing roll 421 into the endless belt 413 on the sheet conveyance speed, when the rotational speed of the rotational drive roll 411 of the belt unit 41 is set as each of 266.5 mm/sec, 310.0 mm/sec, 400.0 mm/sec, 450.0 mm/sec, 480.0 mm/sec, and 510.0 mm/sec.

It is found from FIG. 7 that the sheet conveyance speed linearly decreases as the amount of biting increases, regardless of whether the rotational speed of the rotational drive roll 411 is high or low. Even when the shaft rotational speeds are the same, the sheet conveyance speed in a case in which the amount of biting is large is lower than that in a case in which the amount of biting is small. This is conceivably because the rotational drive roll 411 slips with respect to the endless belt 413 due to the increase in the amount of biting of the pressing roll 421 into the endless belt 413.

FIG. 8 and FIG. 9 illustrate the contents in the graphs depicted in FIG. 6 and FIG. 7 in the form of a list.

FIG. 8 illustrates data serving as a basis of the graph illustrated in FIG. 6. Incidentally, in the roll decurler section 3, the correction roll 32 is allowed to move so that the amount of biting of the conveyance drive shaft 31 into the correction roll 32 changes in a range between 0.1 mm and 2.2 mm. Here, five amounts of biting (#1 to #5) from 0.1 mm to 2.2 mm are selected representatively.

In FIG. 8, a column of "SHAFT SPEED SET VALUE A' AFTER ADJUSTMENT" is provided at the right end. "A" that means the same value as the shaft speed set value A is provided for #1, and "0.9974A" that means a value 0.9974 time the shaft speed set value A is provided for #2. This "SHAFT SPEED SET VALUE A' AFTER ADJUSTMENT" is a shaft speed set value that is set for each amount of biting, for the purpose of maintaining the sheet conveyance speed realized at each shaft speed set value A at the time when the amount of biting is #1 regardless of the change in the amount of biting. For example, in a case in which the shaft speed set value A is 500 mm/sec, the sheet conveyance speed when the amount of biting is #1 is 501.8 mm/sec. However, if the amount of biting is changed to #2 while keeping the shaft speed set value A at 500 mm/sec, the sheet conveyance speed increases from 501.8 mm/sec to 503.3 mm/sec. Thus, in order to keep the sheet conveyance speed at 501.8 mm/sec even when the amount of biting is changed to #2, the shaft speed set value may be assumed to be 498.7 mm/sec that is 0.9974 time 500 mm/sec that is the current shaft speed set value A as depicted in the column of "SHAFT SPEED SET VALUE A' AFTER ADJUSTMENT."

FIG. 9 illustrates data serving as a basis of the graph illustrated in FIG. 7. Incidentally, in this belt decurler section 4A, the pressing member 42 is allowed to move so that the amount of biting of the pressing roll 421 into the endless belt 413 changes in a range between 2.2 mm and 7.3 mm. Here, three amounts of biting (#1 to #3) from 2.2 mm to 7.3 mm are selected representatively.

In FIG. 9, a column of "SHAFT SPEED SET VALUE B' AFTER ADJUSTMENT" is provided at the right end. "B" that means the same shaft speed as the shaft speed set value B is provided for #1, and "1.0392B" that means a value 1.0392 times the shaft speed set value B is provided for #2. This "SHAFT SPEED SET VALUE B' AFTER ADJUSTMENT" also is a shaft speed set value that is set for each amount of biting, for the purpose of maintaining the sheet conveyance speed realized at each shaft speed set value B at the time when the amount of biting is #1 regardless of the change in the amount of biting.

In the main-unit controller 101 provided in the image forming device 100, the amount of biting in the roll decurler section 3 is determined based on information about the paper sheet to use and the like, obtained through operation by the operator. Further, in the main-unit controller 101, the shaft speed set value A' of the conveyance drive shaft 31 in the roll decurler section 3 is determined based on the determined amount of biting, information about the sheet conveyance speed obtained through operation by the operator, and a table created based on the data in the column at the right end of FIG. 8. In the main-unit controller 101, the determined shaft speed set value A' is transmitted to the decurler device 1. In the decurler device 1, the conveyance drive shaft 31 is rotated based on the received shaft speed set value A' through the local motor M2 that provides the conveyance drive shaft 31 with a rotational driving force. Furthermore, the main-unit controller 101 adjusts the rotation angle of the first stepping motor SM1 so that the amount of biting in the roll decurler section 3 is equal to the determined amount of biting.

Moreover, in the main-unit controller 101, the amount of biting in the belt decurler section 4 is determined based on the information about the paper sheet and the like, and the shaft speed set value B' of the rotational drive roll 411 in the belt decurler section 4 is determined based on the determined amount of biting, the information about the sheet conveyance speed, and a table created based on the data in the column at the right end of FIG. 9. In the main-unit controller 101, the rotational drive roll 411 is rotated based on the determined shaft speed set value B' through the main motor M1 that provides the rotational drive roll 411 with a rotational driving force. Further, the main-unit controller 101 adjusts the rotation angle of the second stepping motor SM2 so that the amount of biting in the belt decurler section 4 is equal to the determined amount of biting.

FIG. 10 is a diagram that illustrates a relationship between the amount of biting and the shaft speed set value in each of the roll decurler section and the belt decurler section.

FIG. 10 illustrates, as examples, the shaft speed set value A' and the shaft speed set value B' used for maintaining, in both the roll decurler section 3 and the belt decurler section 4, a sheet conveyance speed of 448.5 mm/sec for every combination of the amount of biting in the roll decurler section 3 and that in the belt decurler section 4.

In the decurler device 1, the paper conveyance in the roll decurler section 3 is controlled by using the drive system of the local motor M2 provided in the decurler device 1, and the paper conveyance in the belt decurler section 4 is controlled by using the drive system of the main motor M1 provided in the main unit side. For example, when the paper conveyance in the roll decurler section 3 and the paper conveyance in the belt decurler section 4 are performed by the same drive system, there is a possibility that a difference may be caused between the sheet conveyance speed in the roll decurler section 3 and the sheet conveyance speed in the belt decurler section 4. Therefore, in the decurler device 1, the paper conveyance in the roll decurler section 3 and the adjustment of the sheet conveyance speed in the belt decurler section 4 are performed by using separate drive systems, so that the sheet conveyance speeds are made to agree with each other with high precision. Hence, for example, a Z crease due to a high sheet conveyance speed in the roll decurler section 3 and a low sheet conveyance speed in the belt decurler section is prevented from occurring. This is the explanation of the reason why the drive source of the roll decurler section 3 and the drive source of the belt decurler section 4 are provided separately.

The description of the decurler device 1 is temporarily stopped here, and the fixing device 400 provided in the image forming device 100 will be described.

Figure 11:
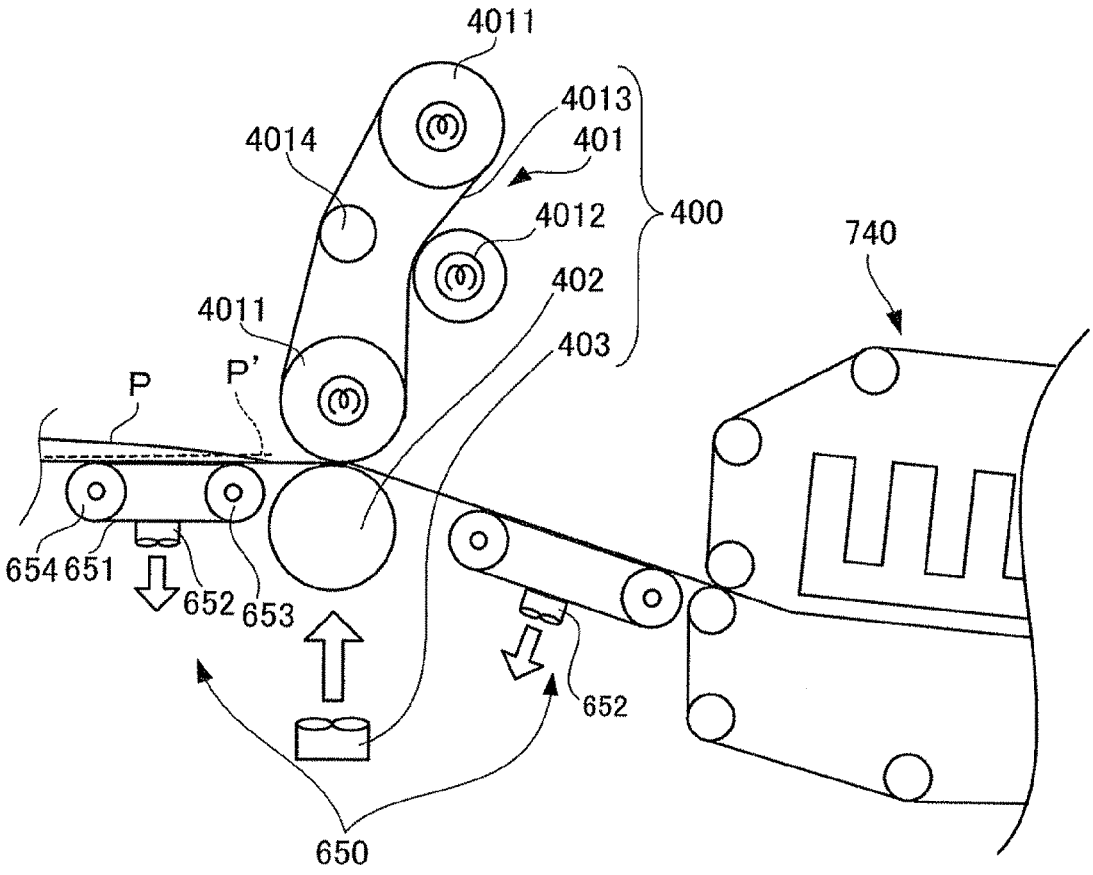
FIG. 11 is a schematic structural diagram of a part around the fixing device.

FIG. 11 is a schematic structural diagram of a part around the fixing device.

The fixing device 400 illustrated in FIG. 11 includes a heat applying section 401, a pressure roll 402 and a cooling fan 403.

The heat applying section 401 includes a heating belt 4013, a first heating roll 4011, a second heating roll 4012 and a tension roll 4014. The first heating roll 4011 heats the heating belt 4013 from the inside of the heating belt 4013, and the second heating roll 4012 heats the heating belt 4013 from the outside of the heating belt 4013.

The cooling fan 403 is disposed below the pressure roll 402, and blows air from below the pressure roll 402, thereby preventing the pressure roll 402 from being overheated.

FIG. 11 illustrates the sucking conveyance devices 650 disposed upstream and downstream from the fixing device 400 in the sheet conveyance course so that the fixing device 400 is disposed in between. FIG. 11 also illustrates the cooling device 740 provided downstream from the sucking conveyance device 650 disposed downstream from the fixing device 400.

Each of the sucking conveyance devices 650 has the conveyance belt 651, a drive roll 653, a tension roll 654 and an exhaust fan 652.

The conveyance belt 651 has a small-diameter bore passing through both sides of the conveyance belt 651. Air in a space surrounded by the conveyance belt 651, the drive roll 653 and the tension roll 654 is exhausted by the exhaust fan 652 to form a negative pressure inside the space, so that the paper sheet is made to cling to the surface of the conveyance belt 651.

Further, FIG. 11 illustrates the paper sheet immediately before that the tip arrives at a nip portion formed by the heat applying section 401 and the pressure roll 402. Here, a paper sheet P curling down at both ends is indicated by a solid line, while the paper sheet P' curling up at both ends is indicated by a dotted line.

When the paper sheet P' indicated by the dotted line enters the nip portion, the tip of the paper sheet P' may collide with the heating belt 4013, forming a fold so-called dog-ear at a corner of the paper sheet, or the tip of the paper sheet P' may not successfully enter the nip portion, thereby causing a jam.

Therefore, it is conceivable to suppress the curling up of the tip by making the exhaust fan 652 stronger thereby allowing the tip to cling to the conveyance belt 651. However, when the exhaust fan 652 is strongly operated, an air stream to lower the temperature of the heating belt 4013 is caused. For this reason, in the image forming device 100, the exhaust fan 652 is made to operate to a required minimum degree and thus, it is difficult to use the exhaust fan 652 to prevent the curling up.

Incidentally, it is considered that a curl like that of the paper sheet P' illustrated in FIG. 11 is formed at a paper sheet having a toner image fixed only on one side. Therefore, a dog-ear or a jam is highly likely to often occur at the time of the second fixing in the double-sided printing mode in which the fixing of the toner image is carried out for each side, i.e. twice in total. For example, when the paper sheet having a toner image fixed on one side and conveyed on the conveyance course illustrated in FIG. 5 curls down thereby bulging in a central part upon passing through the roll decurler section 3 and the belt decurler section 4, the paper sheet is subsequently conveyed to the front-and-back inversion course R2 so that the toner image is transferred to the other side and the paper sheet is then conveyed to the fixing device 400. The state of this paper sheet is the same as that of the paper sheet P' illustrated in FIG. 11. Thus, in the decurler device 1, in a case where the double-sided printing mode is selected, when the paper sheet after the toner image is fixed on one side has a curl with an upward bulge in the central part, the paper sheet is corrected to have a curl with a slightly downward bulge in the central part. On the other hand, when the paper sheet after the toner image is fixed on one side originally has a curl with a downward bulge in the central part, the curl is corrected to be soft to the extent that the curl does not have an upward bulge in the central part. Further, in this decurler device 1, in a case where the double-sided printing mode is selected, when the paper sheet after the toner image is fixed on one side is accompanied by a curl with a slightly downward bulge in the central part, no correction is performed. In the decurler device 1, based on various conditions such as a temperature, a humidity and an image density other than the type of paper sheet selected by the operator, a curl of the paper sheet after the fixing is estimated and corrected in the manner described above. Further, the decurler device 1 recognizes the types of paper sheet whose central part is likely to bulge downward always after the toner image is fixed even when the conditions such as the temperature, humidity and image density are changed. When the type of paper sheet selected by the operator is one of the recognized types of paper sheet, no correction is performed. Furthermore, in the decurler device 1, when the single-sided printing mode is selected, in either of two cases, where the paper sheet after the toner image is fixed on one side is accompanied by a curl with an upward bulge in a central part and where the paper sheet after the toner image is fixed on one side is accompanied by a curl with a downward bulge in a central part, the curl is corrected to be soft. Here, the description of the exemplary embodiment is temporarily stopped, and an experimental example will be described.

For this example, a sucking fan disposed immediately upstream from a fixing device in a printer made by Fuji Xerox is replaced with another one capable of switching between ON (use in low output) and OFF, and a high temperature (35° C.) a high humidity (70%), a normal temperature (20° C.) and a normal humidity (40%) are prepared as operation environments. Further, as the paper sheets to be conveyed, there are prepared surface untreated plain sheets having the same size of SRA3 and different basis weights as well as surface treated coated sheets having the same size of SRA3 and different basis weights.

In this example, after transferring and fixing a toner image on one side of each type of paper sheet, the combination of the amounts of biting of the roll decurler section and the belt decurler section is changed every 45 sheets. Also, for some of the sheets, a curl is corrected every 45 sheets in each of a case where the sucking fan is turned on and a case where the sucking fan is turned off, and under these conditions, for the sheets after finishing the transfer of the toner image on the other side and conveyed toward the fixing device again to undergo the fixing, there are observed and evaluated: a behavioral tendency of the tip of the paper sheet immediately before entering a nip portion of the fixing device; a maximum amount of curling up; the timing of occurrence of a jam; and the number of dog-eared sheets. As for the remaining sheets other than the some of the sheets, a curl is corrected while leaving the sucking fan on, and there are observed and evaluated: a behavioral tendency of the tip of the paper sheet immediately before entering the nip portion of the fixing device; a maximum amount of curling up; the timing of occurrence of a jam; and the number of dog-eared sheets. Incidentally, three levels of large (R3), medium (R2) and small (R1) are prepared as the amount of biting in the roll decurler section, whereas three levels of large (B3), medium (B2) and small (B1) are prepared as the amount of biting in the belt decurler section. The larger the amount of biting is, the stronger the correction intensity is. Also, when the amounts of biting are in the same level, the intensities of correcting the sheets are equal.

At first, an experiment performed in a normal temperature and humidity environment will be described.

A comparative example 1 is a case where a curl of a paper sheet P that is a plain sheet having a basis weight of 64 gsm is corrected in the normal temperature and humidity environment, when the amount of biting in the roll decurler section is R3 and the amount of biting in the belt decurler section is B1 in a state of the sucking fan being turned off.

A comparative example 2 is the same as the comparative example 1 except that the sucking fan is turned on.

A comparative example 3 is the same as the comparative example 2 except that a paper sheet J that is a plain sheet of 82 gsm is used.

A comparative example 4 is the same as the comparative example 1 except that the amount of biting in the roll decurler section is R2.

A comparative example 5 is the same as the comparative example 2 except that the amount of biting in the roll decurler section is R2.

A comparative example 6 is the same as the comparative example 3 except that the amount of biting in the roll decurler section is R2.

A comparative example 7 is the same as the comparative example 1 except that the amount of biting in the roll decurler section is R1.

A comparative example 8 is the same as the comparative example 2 except that the amount of biting in the roll decurler section is R1.

A comparative example 9 is the same as the comparative example 3 except that the amount of biting in the roll decurler section is R1.

An example 1 is the same as the comparative example 7 except that the amount of biting in the belt decurler section is B2.

An example 2 is the same as the comparative example 8 except that the amount of biting in the belt decurler section is B2.

An example 3 is the same as the comparative example 9 except that the amount of biting in the belt decurler section is B2.

A comparative example 10 is a case where a curl of an OKT sheet that is a coated sheet having a basis weight of 64 gsm is corrected when the amount of biting in the roll decurler section is R3 and the amount of biting in the belt decurler section is B1 in the state of the sucking fan being turned off.

An example 4 is the same as the comparative example 10 except that the sucking fan is turned on.

An example 5 is the same as the example 4 except that a JD sheet that is a coated sheet having a basis weight of 104 gsm is used.

A comparative example 11 is the same as the comparative example 10 except that the amount of biting in the roll decurler section is R2.

An example 6 is the same as the comparative example 11 except that the sucking fan is turned on.

An example 7 is the same as the example 6 except the JD sheet that is a coated sheet having a basis weight of 104 gsm is used.

An example 8 is the same as the comparative example 11 except that the amount of biting in the roll decurler section is R1.

An example 9 is the same as the example 8 except that the sucking fan is turned on.

An example 10 is the same as the example 7 except that the amount of biting in the roll decurler section is R1.

An example 11 is the same as the example 8 except that the amount of biting in the belt decurler section is B2.

An example 12 is the same as the example 11 except that the sucking fan is turned on.

An example 13 is the same as the example 10 except that the amount of biting in the belt decurler section is B2.

Among the evaluation items, the behavior is evaluated as "Failure" when a jam is very likely to happen, as "Fair" when the tip of the paper sheet flaps slightly, and as "Excellent" when stability is achieved. Further, the amount of curling up is indicated by a value obtained by detecting the height of the curling-up tip of the paper sheet with an optical sensor. The occurrence of a jam is indicated by in what number of 45 sheets the jam occurs. As for the dog-ear, in what number of 45 sheets a dog-ear is formed is indicated. As a comprehensive judgment, "Failure" is provided when there is a problem in the correction state, "Fair" is provided when the correction state is in an allowable range, and "Excellent" is provided when there is no problem in the correction state.

TABLE 1

| | Amount of biting (R/B) | FAN | Paper type (basis weight) | Coating | Behavior | Maximum amount of curling up | JAM | Dog-ear | Comprehensive judgment |
|---|---|---|---|---|---|---|---|---|---|
| Comparative Example 1 | (R3/B1) | OFF | P (64) | No | Failure | 8 | 0 | 1 | Failure |
| Comparative Example 2 | (R3/B1) | ON | P (64) | No | Fair | 8 | 0 | 0 | Failure |
| Comparative Example 3 | (R3/B1) | ON | J (82) | No | Failure | 14 | 0 | 1 | Failure |
| Comparative Example 4 | (R2/B1) | OFF | P (64) | No | Fair | 8 | 0 | 0 | Failure |
| Comparative Example 5 | (R2/B1) | ON | P (64) | No | Fair | 9 | 0 | 0 | Failure |
| Comparative Example 6 | (R2/B1) | ON | J (82) | No | Failure | 9 | 0 | 1 | Failure |
| Comparative Example 7 | (R1/B1) | OFF | P (64) | No | Fair | 8 | 0 | 0 | Failure |
| Comparative Example 8 | (R1/B1) | ON | P (64) | No | Excellent | 9 | 0 | 0 | Failure |
| Comparative Example 9 | (R1/B1) | ON | J (82) | No | Fair | 9 | 0 | 0 | Failure |
| Example 1 | (R1/B2) | OFF | P (64) | No | Excellent | 3 | 0 | 0 | Fair |
| Example 2 | (R1/B2) | ON | P (64) | No | Excellent | 4 | 0 | 0 | Fair |
| Example 3 | (R1/B2) | ON | J (82) | No | Excellent | 5 | 0 | 0 | Fair |
| Comparative Example 10 | (R3/B1) | OFF | OKT (73) | Yes | Fair | 6 | 1/45 | — | Failure |
| Example 4 | (R3/B1) | ON | OKT (73) | Yes | Fair | 5 | 0 | 0 | Fair |
| Example 5 | (R3/B1) | ON | JD (104) | Yes | Excellent | 6 | 0 | 0 | Fair |
| Comparative Example 11 | (R2/B1) | OFF | OKT (73) | Yes | Fair | 4 | 1/45 | — | Failure |
| Example 6 | (R2/B1) | ON | OKT (73) | Yes | Excellent | 3 | 0 | 0 | Fair |
| Example 7 | (R2/B1) | ON | JD (104) | Yes | Excellent | 4 | 0 | 0 | Fair |
| Example 8 | (R1/B1) | OFF | OKT (73) | Yes | Excellent | 1 | 0 | 0 | Excellent |
| Example 9 | (R1/B1) | ON | OKT (73) | Yes | Excellent | 2 | 0 | 0 | Excellent |
| Example 10 | (R1/B1) | ON | JD (104) | Yes | Excellent | 1 | 0 | 0 | Excellent |
| Example 11 | (R1/B2) | OFF | OKT (73) | Yes | Excellent | 0 | 0 | 0 | Excellent |
| Example 12 | (R1/B2) | ON | OKT (73) | Yes | Excellent | 2 | 0 | 0 | Excellent |
| Example 13 | (R1/B2) | ON | JD (104) | Yes | Excellent | 0 | 0 | 0 | Excellent |

Table 1 includes the contents and the like of the examples 1-13 and the comparative examples 1-11 carried out in the normal temperature and humidity environment.

In the comparative example 1, the behavior is "Failure", the maximum amount of curling up is 8 mm, there is no occurrence of a jam, and a dog-ear is formed in one out of 45 sheets and therefore, the comprehensive judgment is "Failure".

In the comparative example 2, there is no occurrence of a Jam and a dog-ear, but the behavior is "Fair" and the maximum amount of curling up is 8 mm and therefore, the comprehensive judgment is "Failure".

In the comparative example 3, there is no occurrence of a jam, but the behavior is "Failure", the maximum amount of curling up is 14 mm and a dog-ear is formed in one out of 45 sheets. Therefore, the comprehensive judgment is "Failure".

In the comparative example 4, there is no occurrence of a jam and a dog-ear, but the behavior is "Fair" and the maximum amount of curling up is 8 mm and therefore, the comprehensive judgment is "Failure".

In the comparative example 5, there is no occurrence of a jam and a dog-ear, but the behavior is "Fair" and the maximum amount of curling up is 9 mm and therefore, the comprehensive judgment is "Failure".

In the comparative example 6, there is no occurrence of a jam, but the behavior is "Failure", the maximum amount of curling up is 9 mm and a dog-ear is formed in one out of 45 sheets. Therefore, the comprehensive judgment is "Failure".

In the comparative example 7, there is no occurrence of a jam and a dog-ear, but the behavior is "Fair" and the maximum amount of curling up is 8 mm and therefore, the comprehensive judgment is "Failure".

In the comparative example 8, there is no occurrence of a jam and a dog-ear and the behavior is "Excellent", but the maximum amount of curling up is 9 mm and therefore, the comprehensive judgment is "Failure."

In the comparative example 9, there is no occurrence of a jam and a dog-ear, but the behavior is "Fair" and the maximum amount of curling up is 9 mm and therefore, the comprehensive judgment is "Failure."

In the example 1, there is no occurrence of a jam and a dog-ear, the behavior is "Excellent" and the maximum amount of curling up is 3 mm and therefore, the comprehensive judgment is "Fair".

In the example 2, there is no occurrence of a jam and a dog-ear, the behavior is "Excellent" and the maximum amount of curling up is 3 mm and therefore, the comprehensive judgment is "Fair".

In the example 3, there is no occurrence of a jam and a dog-ear, the behavior is "Excellent" and the maximum amount of curling up is 5 mm and therefore, the comprehensive judgment is "Fair".

In the comparative example 10, the behavior is "Fair", the maximum amount of curling up is 6 mm and there is an occurrence of a jam in one out of 45 sheets. Therefore, the comprehensive judgment is "Failure".

In the example 4, there is no occurrence of a jam and a dog-ear, the behavior is "Fair" and the maximum amount of curling up is 5 mm and therefore, the comprehensive judgment is "Fair".

In the example 5, there is no occurrence of a jam and a dog-ear, the behavior is "Excellent" and the maximum amount of curling up is 6 mm and therefore, the comprehensive judgment is "Fair".

In the comparative example 11, the behavior is "Failure", the maximum amount of curling up is 4 mm and there is an occurrence of a jam in one out of 45 sheets. Therefore, the comprehensive judgment is "Failure".

In the example 6, there is no occurrence of a jam and a dog-ear, the behavior is "Excellent" and the maximum amount of curling up is 3 mm and therefore, the comprehensive judgment is "Fair".

In the example 7, there is no occurrence of a jam and a dog-ear, the behavior is "Excellent" and the maximum amount of curling up is 4 mm and therefore, the comprehensive judgment is "Fair".

In the example 8, there is no occurrence of a jam and a dog-ear, the behavior is "Excellent" and the maximum amount of curling up is 1 mm and therefore, the comprehensive judgment is "Excellent".

In the example 9, there is no occurrence of a jam and a dog-ear, the behavior is "Excellent" and the maximum amount of curling up is 2 mm and therefore, the comprehensive judgment is "Excellent".

In the example 10, there is no occurrence of a jam and a dog-ear, the behavior is "Excellent" and the maximum amount of curling up is 1 mm and therefore, the comprehensive judgment is "Excellent".

In the example 11, there is no occurrence of a jam and a dog-ear, the behavior is "Excellent" and the maximum amount of curling up is 0 mm and therefore, the comprehensive judgment is "Excellent".

In the example 12, there is no occurrence of a jam and a dog-ear, the behavior is "Excellent" and the maximum amount of curling up is 2 mm and therefore, the comprehensive judgment is "Excellent".

In the example 13, there is no occurrence of a jam and a dog-ear, the behavior is "Excellent" and the maximum amount of curling up is 0 mm and therefore, the comprehensive judgment is "Excellent".

From the comparative examples 1-9 and the examples 1-3, it is found that, in the normal temperature and humidity environment, for the plain sheet having a basis weight of 64 gsm or more and the toner image fixed only on one side, the correction by the belt decurler section that depresses the side where the toner image is fixed and thereby raising the both ends is intensified, so that the toner image transferred to the other side is successfully fixed regardless of the on/off state of the fan.

From the comparative examples 10 and 11, and the examples 4-7, it is found that, in the normal temperature and humidity environment, for the coated sheet having a basis weight of 73 gsm or more and the toner image fixed only on one side, even when the correction by the roll decurler section that bulges the side where the toner image is fixed is intensified, the toner image transferred to the other side is barely fixed if the fan is turned on.

Further, from the examples 8-13, it is found that, in the normal temperature and humidity environment, for the coated sheet having a basis weight of 73 gsm or more and the toner image fixed only on one side, if the roll decurler section and the belt decurler section are equal in terms of correction intensity, the toner image transferred to the other side is successfully fixed regardless of the on/off state of the fan.

Thus, it is found that as compared to the plain sheets, the coated sheets are likely to have a downwardly bulging curl in the central part, and the correction intensity of the belt decurler section in the double-sided printing mode is not required to greatly exceed the correction intensity of the roll decurler section.

Next, an experiment performed in a high temperature and humidity environment will be described.

A comparative example 12 is a case where a curl of a paper sheet P that is a plain sheet having a basis weight of 64 gsm is corrected in the high temperature and humidity environment, when the amount of biting in the roll decurler section is R3 and the amount of biting in the belt decurler section is B1 in a state of the sucking fan being turned off.

A comparative example 13 is the same as the comparative example 12 except that the sucking fan is turned on.

A comparative example 14 is the same as the comparative example 13 except that a paper sheet J that is a plain sheet having a basis weight of 82 gsm is used.

A comparative example 15 is the same as the comparative example 12 except that the amount of biting in the roll decurler section is R2.

A comparative example 16 is the same as the comparative example 13 except that the amount of biting in the roll decurler section is R2.

A comparative example 17 is the same as the comparative example 14 except that the amount of biting in the roll decurler section is R2.

A comparative example 18 is the same as the comparative example 12 except that the amount of biting in the roll decurler section is R1.

A comparative example 19 is the same as the comparative example 13 except that the amount of biting in the roll decurler section is R1.

A comparative example 20 is the same as the comparative example 14 except that the amount of biting in the roll decurler section is R1.

A comparative example 21 is the same as the comparative example 18 except that the amount of biting in the belt decurler section is B2.

A comparative example 22 is the same as the comparative example 19 except that the amount of biting in the belt decurler section is B2.

A comparative example 23 is the same as the comparative example 20 except that the amount of biting in the belt decurler section is B2.

An example 14 is the same as the comparative example 18 except that the amount of biting in the belt decurler section is B3.

An example 15 is the same as the comparative example 19 except that the amount of biting in the belt decurler section is B3.

An example 16 is the same as the comparative example 20 except that the amount of biting in the belt decurler section is B3.

A comparative example 24 is a case where a curl of an OKT sheet that is a coated sheet having a basis weight of 73 gsm is corrected, when the amount of biting in the roll decurler section is R3 and the amount of biting in the belt decurler section is B1 in a state of the sucking fan being turned off.

An example 17 is the same as the comparative example 24 except that the sucking fan is turned on.

A comparative example 25 is the same as the example 17 except that a JD sheet that is a coated sheet having a basis weight of 104 gsm is used.

An example 18 is the same as the comparative example 24 except that the amount of biting in the roll decurler section is R2.

An example 19 is the same as the example 17 except that the amount of biting in the roll decurler section is R2.

A comparative example 26 is the same as the comparative example 25 except that the amount of biting in the roll decurler section is R2.

An example 20 is the same as the comparative example 24 except that the amount of biting in the roll decurler section is R1.

An example 21 is the same as the example 17 except that the amount of biting in the roll decurler section is R1.

An example 22 is the same as the comparative example 25 except that the amount of biting in the roll decurler section is R1.

TABLE 2

| | Amount of biting (R/B) | FAN | Paper type (Basis weight) | Coat-ing | Be-havior | Maximum amount of curling up | JAM | Dog-ear | Compre-hensive Judgment |
|---|---|---|---|---|---|---|---|---|---|
| Comparative Example 12 | (R3/B1) | OFF | P (64) | No | Failure | 14 | 5/45 | 4 | Failure |
| Comparative Example 13 | (R3/B1) | ON | P (64) | No | Failure | 14 | 15/45 | 2 | Failure |
| Comparative Example 14 | (R3/B1) | ON | J (82) | No | Failure | 16 | 10/45 | 5 | Failure |
| Comparative Example 15 | (R2/B1) | OFF | P (64) | No | Failure | 9 | 20/45 | 3 | Failure |
| Comparative Example 16 | (R2/B1) | ON | P (64) | No | Failure | 12 | 0 | 6 | Failure |
| Comparative Example 17 | (R2/B1) | ON | J (82) | No | Failure | 12 | 15/45 | 3 | Failure |
| Comparative Example 18 | (R1/B1) | OFF | P (64) | No | Failure | 8 | 0 | 1 | Failure |
| Comparative Example 19 | (R1/B1) | ON | P (64) | No | Failure | 11 | 0 | 8 | Failure |
| Comparative Example 20 | (R1/B1) | ON | J (82) | No | Failure | 8 | 0 | 3 | Failure |
| Comparative Example 21 | (R1/B2) | OFF | P (64) | No | Failure | 7 | 31/45 | 1 | Failure |
| Comparative Example 22 | (R1/B2) | ON | P (64) | No | Excellent | 8 | 0 | 0 | Failure |
| Comparative Example 23 | (R1/B2) | ON | J (82) | No | Fair | 6 | 0 | 0 | Failure |
| Example 14 | (R1/B3) | OFF | P (64) | No | Fair | 2 | 0 | 0 | Fair |
| Example 15 | (R1/B3) | ON | P (64) | No | Excellent | 2 | 0 | 0 | Excellent |
| Example 16 | (R1/B3) | ON | J (82) | No | Excellent | 2 | 0 | 0 | Excellent |
| Comparative Example 24 | (R3/B1) | OFF | OKT (73) | Yes | Fair | 5 | 20/45 | 1 | Failure |
| Example 17 | (R3/B1) | ON | OKT (73) | Yes | Excellent | 5 | 0 | 0 | Fair |

TABLE 2-continued

| | Amount of biting (R/B) | FAN | Paper type (Basis weight) | Coat-ing | Be-havior | Maximum amount of curling up | JAM | Dog-ear | Compre-hensive Judgment |
|---|---|---|---|---|---|---|---|---|---|
| Comparative Example 25 | (R3/B1) | ON | JD (104) | Yes | Fair | 9 | 0 | 0 | Failure |
| Example 18 | (R2/B1) | OFF | OKT (73) | Yes | Fair | 5 | 0 | 0 | Fair |
| Example 19 | (R2/B1) | ON | OKT (73) | Yes | Excellent | 4 | 0 | 0 | Fair |
| Comparative Example 26 | (R2/B1) | ON | JD (104) | Yes | Fair | 8 | 0 | 0 | Failure |
| Example 20 | (R1/B1) | OFF | OKT (73) | Yes | Excellent | 3 | 0 | 0 | Fair |
| Example 21 | (R1/B1) | ON | OKT (73) | Yes | Excellent | 4 | 0 | 0 | Fair |
| Example 22 | (R1/B1) | ON | JD (104) | Yes | Excellent | 2 | 0 | 0 | Excellent |

Table 2 includes the contents and the like of the examples 14-22 and the comparative examples 12-26 performed in the high temperature and humidity environment.

In the comparative example 12, the behavior is "Failure", the maximum amount of curling up is 14 mm, there is an occurrence of a jam in the 5th of 45 sheets, and dog-ears are formed in four sheets before the occurrence of the jam. Therefore, the comprehensive judgment is "Failure".

In the comparative example 13, the behavior is "Failure", the maximum amount of curling up is 14 mm, there is an occurrence of a jam in the 15th of 45 sheets, and dog-ears are formed in two sheets before the occurrence of the jam. Therefore, the comprehensive judgment is "Failure".

In the comparative example 14, the behavior is "Failure", the maximum amount of curling up is 16 mm, there is an occurrence of a jam in the 10th of 45 sheets, and dog-ears are formed in five sheets before the occurrence of the jam. Therefore, the comprehensive judgment is "Failure".

In the comparative example 15, the behavior is "Failure", the maximum amount of curling up is 9 mm, there is an occurrence of a jam in the 20th of 45 sheets, and dog-ears are formed in three sheets before the occurrence of the jam. Therefore, the comprehensive judgment is "Failure".

In the comparative example 16, there is no occurrence of a jam, but the behavior is "Failure", the maximum amount of curling up is 12 mm, and dog-ears are formed in six sheets before the occurrence of the jam. Therefore, the comprehensive judgment is "Failure".

In the comparative example 17, the behavior is "Failure", the maximum amount of curling up is 12 mm, there is an occurrence of a jam in the 15th of 45 sheets, and dog-ears are formed in three sheets before the occurrence of the jam. Therefore, the comprehensive judgment is "Failure".

In the comparative example 18, there is no occurrence of a jam, but the behavior is "Failure", the maximum amount of curling up is 8 mm, and a dog-ear is formed in one out of 45 sheets. Therefore, the comprehensive judgment is "Failure".

In the comparative example 19, there is no occurrence of a jam, but the behavior is "Failure", the maximum amount of curling up is 11 mm, and dog-ears are formed in eight out of 45 sheets. Therefore, the comprehensive judgment is "Failure".

In the comparative example 20, there is no occurrence of a jam, but the behavior is "Failure", the maximum amount of curling up is 8 mm, and dog-ears are formed in three out of 45 sheets. Therefore, the comprehensive judgment is "Failure".

In the comparative example 21, the behavior is "Failure", the maximum amount of curling up is 7 mm, there is an occurrence of a jam in the 31st of 45 sheets, and a dog-ear is formed in one sheet before the occurrence of the jam. Therefore, the comprehensive judgment is "Failure".

In the comparative example 22, the behavior is "Excellent" and there is no occurrence of a dog-ear, but the maximum amount of curling up is 8 mm. Therefore, the comprehensive judgment is "Failure".

In the comparative example 23, there is no occurrence of a jam and a dog-ear, but the behavior is "Fair" and the maximum amount of curling up is 6 mm. Therefore, the comprehensive judgment is "Failure".

In the example 14, there is no occurrence of a jam and a dog-ear, the behavior is "Fair" and the maximum amount of curling up is 2 mm. Therefore, the comprehensive judgment is "Fair".

In the examples 15 and 16, there is no occurrence of a jam and a dog-ear, the behavior is "Excellent" and the maximum amount of curling up is 2 mm. Therefore, the comprehensive judgment is "Excellent".

In the comparative example 24, the behavior is "Fair", the maximum amount of curling up is 5 mm, there is an occurrence of a jam in the 20th of 45 sheets, and a dog-ear is formed in one sheet before the occurrence of the jam. Therefore, the comprehensive judgment is "Failure".

In the example 17, there is no occurrence of a jam and a dog-ear, the behavior is "Excellent" and the maximum amount of curling up is 5 mm. Therefore, the comprehensive judgment is "Fair".

In the comparative example 25, the behavior is "Fair" and there is no occurrence of a jam and a dog-ear, but the maximum amount of curling up is 9 mm. Therefore, the comprehensive judgment is "Failure".

In the example 18, there is no occurrence of a jam and a dog-ear, the behavior is "Fair" and the maximum amount of curling up is 5 mm. Therefore, the comprehensive judgment is "Fair".

In the example 19, there is no occurrence of a jam and a dog-ear, the behavior is "Excellent" and the maximum amount of curling up is 4 mm. Therefore, the comprehensive judgment is "Fair".

In the comparative example 26, the behavior is "Fair" and there is no occurrence of a jam and a dog-ear, but the maximum amount of curling up is 8 mm. Therefore, the comprehensive judgment is "Failure".

In the example 20, there is no occurrence of a jam and a dog-ear, the behavior is "Excellent" and the maximum amount of curling up is 3 mm. Therefore, the comprehensive judgment is "Excellent".

In the example 21, there is no occurrence of a jam and a dog-ear, the behavior is "Excellent" and the maximum amount of curling up is 4 mm. Therefore, the comprehensive judgment is "Fair".

In the example 22, there is no occurrence of a jam and a dog-ear, the behavior is "Excellent" and the maximum amount of curling up is 2 mm. Therefore, the comprehensive judgment is "Excellent".

From the comparative examples 12-23 and the examples 14-16, it is found that, in the high temperature and humidity environment, for the plain sheet having a basis weight of 64 gsm or more and the toner image fixed only on one side, unless the correction by the belt decurler section that depresses the side where the toner image is fixed is intensified, the toner image transferred to the other side is not successfully fixed.

From the comparative examples 24 and 25 and the example 17, it is found that, in the high temperature and humidity environment, for the coated sheet having a basis weight of 73 gsm and the toner image fixed only on one side, if the correction intensity of the roll decurler section is far stronger than that of the belt decurler section, the toner image transferred to the other side is barely fixed successfully as long as the fan is turned on, but the toner image is not successfully fixed even if the fan is turned on for the coated sheet having a basis weight of 104 gsm.

Further, from the examples 18 and 19 and the comparative example 26, it is found that, in the high temperature and humidity environment, for the coated sheet having a basis weight of 73 gsm and the toner image fixed only on one side, if the correction intensity of the roll decurler section is stronger than that of the belt decurler section, the toner image transferred to the other side is successfully fixed regardless of the on/off state of the fan, but the toner image is not successfully fixed even when the fan is turned on for the coated sheet having a basis weight of 104 gsm.

Furthermore, from the examples 20 to 22, it is found that, in the high temperature and humidity environment, for the coated sheet having a basis weight of 73 gsm or more and the toner image fixed only on one side, if the roll decurler section and the belt decurler section are equal in term of correction intensity, the toner image transferred to the other side is successfully fixed regardless of the on/off state of the fan.

In view of the above results, it is found that as compared to the plain sheets, the coated sheets are likely to have a curl with a downward bulge in the central part due to the fixing of the toner image on the one side, and the correction intensity of the belt decurler section in the double-sided printing mode is not required to greatly exceed the correction intensity of the roll decurler section. Furthermore, in the high temperature and humidity environment, the degree of the correction intensity of the belt decurler section exceeding the correction intensity of the roll decurler section may need to be larger than that in the normal temperature and humidity environment. This concludes the description of efforts to prevent the occurrence of a jam in the double-sided mode and thus completes the description of the experimental examples.

Now, the decurler device 1 will be described in detail.

In the decurler device 1, the cooling device 740 illustrated in FIG. 1 and a drawer are both capable of being drawn from the main-unit housing of the image forming device 100. Various motors that supply driving forces to the decurler device 1 are disposed at locations deeper than the decurler device 1 housed at a predetermined position of the image forming device 100.

Figure 12:
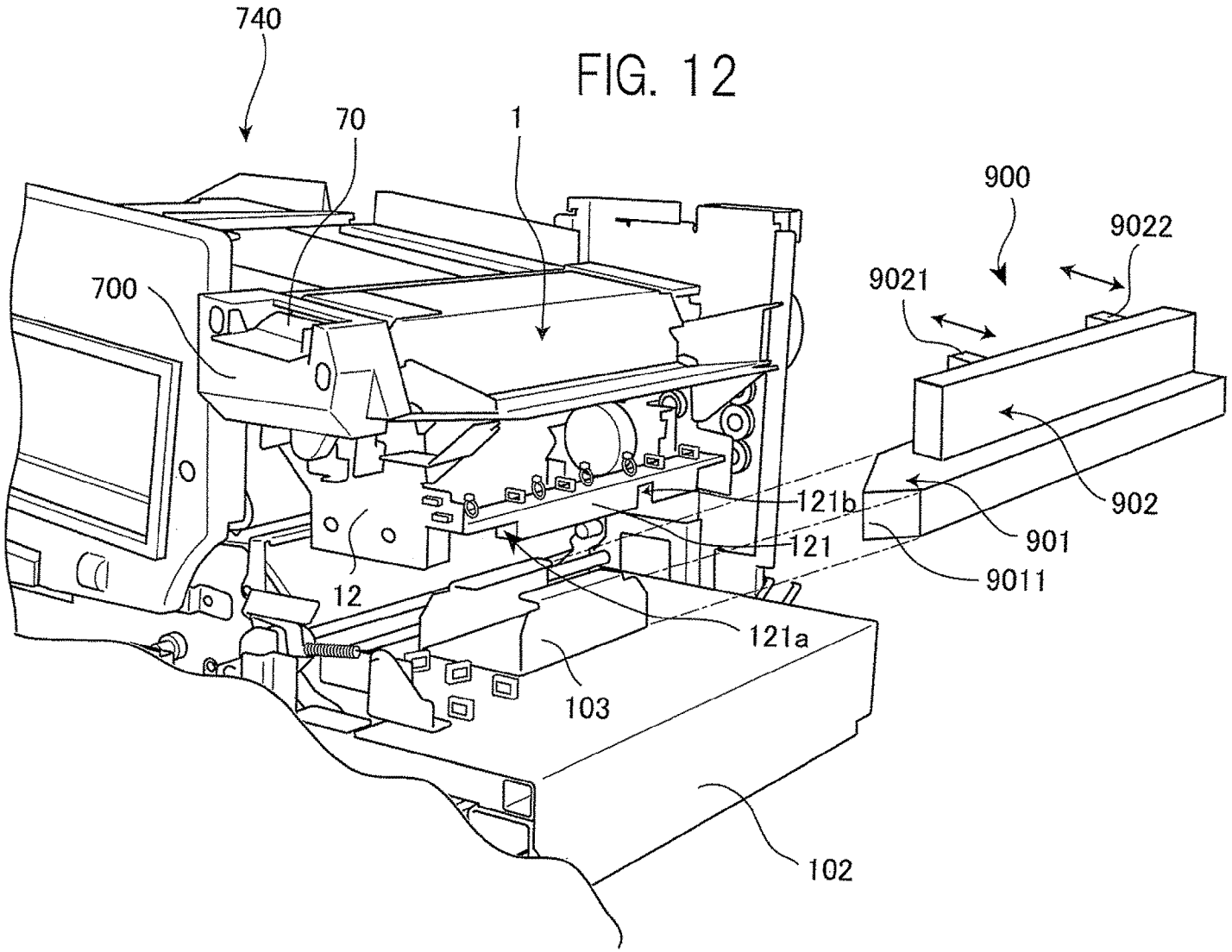
FIG. 12 is an external perspective view of the decurler device being drawn from a main-unit housing.

FIG. 12 is an external perspective view of the decurler device being drawn from the main-unit housing.

FIG. 12 illustrates the decurler device 1 fixed on a drawer plate 102 together with the cooling device 740. Incidentally, in FIG. 12, illustration of a fixing member that fixes the decurler device 1 to the top surface of the drawer plate 102 is omitted for convenience of the description.

The gross weight of the cooling device 740, the decurler device 1, and the drawer plate 102 with the top surface to which the cooling device 740 and the decurler device 1 are fixed, combined, is 100 kilograms. For this reason, in a return to the inside of the main-unit housing, in order to prevent the decurler device 1 from colliding with other members in the main-unit housing when the drawer plate 102 is pushed toward the main unit side by the operator, a guide member 103 is provided on the top surface of the drawer plate 102.

Further, FIG. 12 illustrates a state in which a first notch 121*a* and a second notch 121*b* are formed on an bottom-part flank 121 of a lower housing 12 of the decurler device 1.

FIG. 12 further illustrates a protruding member 900 provided on a rearward side of the main-unit housing.

The protruding member 900 includes a lower section 901 that enters the guide member 103 as the drawer plate 102 travels and an upper section 902 that touches the bottom-part flank 121 of the decurler device 1. The upper section 902 is provided with a first convex section 9021 and a second convex section 9022 which are protruded by the pressing of a spring provided inside and sink into the upper section 902 when being pushed by receiving a force of a certain or greater strength. The protruding member 900 moves along the bottom-part flank 121 of the decurler device 1 while accompanying the travel of the drawer plate 102. The first convex section 9021 is engaged in the first notch 121*a* and the second notch 121*b*, at a moment when the first convex section 9021 faces the first notch 121*a* and a moment when the first convex section 9021 faces the second notch 121*b*, respectively. Meanwhile, the second convex section 9022 is engaged in the second notch 121*b* at a moment when the second convex section 9022 faces the second notch 121*b*. Incidentally, FIG. 12 illustrates the state in which the protruding member 900 is completely removed from the guide member 103 for convenience of the description. However, actually, even when the drawer plate 102 is drawn from the main-unit housing to a maximum extent, the first convex section 9021 is in the state of being engaged in the second notch 121*b* and a tapered part 9011 of the lower section 901 is not removed from the guide member 103. On the other hand, in a state in which the drawer plate 102 is completely housed in the main-unit housing, the first convex section 9021 is engaged in the first notch 121*a* and the second convex section 9022 is engaged in the second notch 121*b*.

In this structure, an orbit of the drawer plate 102 placed on the decurler device 1 when the drawer plate 102 is attached to and detached from the main-unit housing is stable. Therefore, a collision between the decurler device 1 and the members adjacent to the decurler device 1 within the main unit is avoided.

Now, there will be described an opening and closing mechanism of the decurler device 1 divided into the upper section and the lower section at the conveyance course of the paper sheet serving as a boundary.

Figure 13:
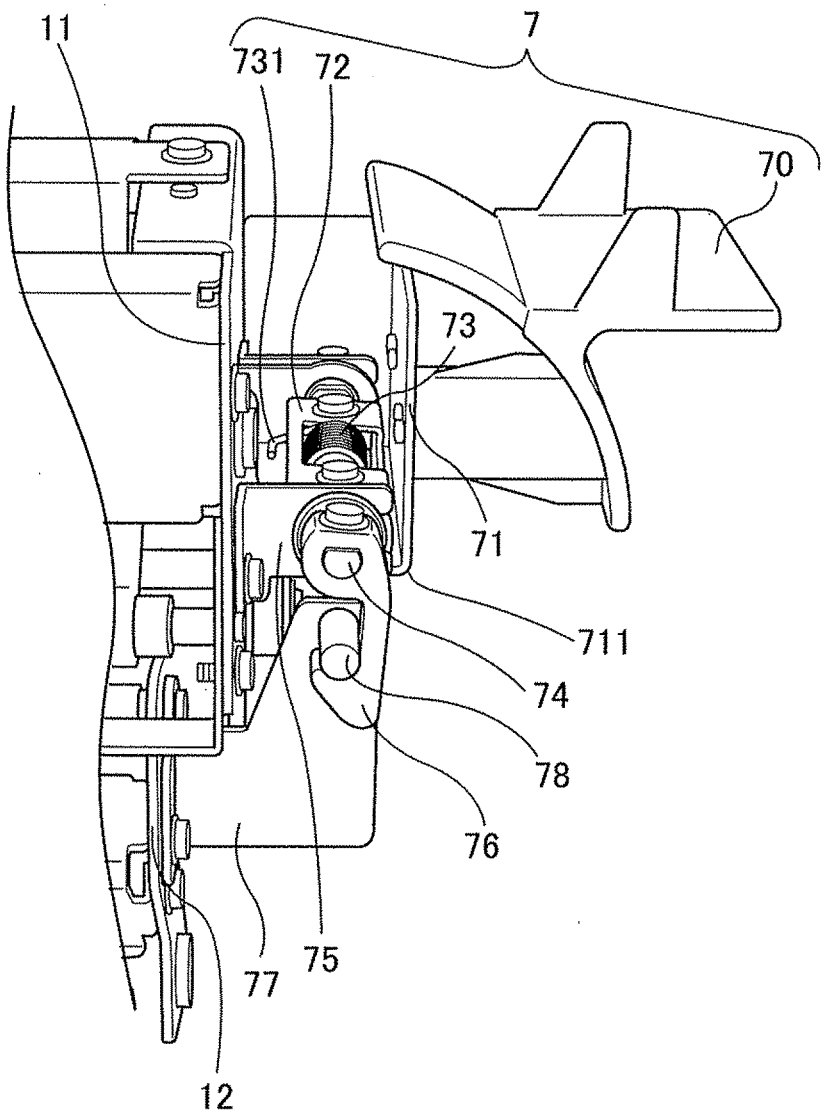
FIG. 13 is an external perspective view of a locking system for locking an upper section into a lower section of the decurler device.

FIG. 13 is an external perspective view of a locking system for locking the upper section into the lower section of the decurler device.

FIG. 13 illustrates a state in which the upper section of the decurler device 1 is locked into the lower section by a locking system 7.

The locking system 7 illustrated in FIG. 13 includes an operating lever 70, an upper plate 71 to which the operating lever 70 is attached, and a pressure plate 72 attached to a surface of the upper plate 71 opposite to a surface where the operating lever 70 is attached. The locking system 7 further includes a torsion spring 73, a penetrating shaft 74 around which the torsion spring 73 is wound, and an upper frame 75 fixed to the upper housing 11 and supporting the penetrating shaft 74 while allowing the penetrating shaft 74 to be rotatable. The locking system 7 further includes a locking member 76 fixed to both ends of the penetrating shaft 74, a locking shaft 78 that holds the locking member 76, and a lower frame 77 provided with the locking shaft 78 and attached to the lower housing 12. One end of the torsion spring 73 is fixed to the penetrating shaft 74, and the other end is supported by the upper frame 75. In this locking system 7, the operating lever 70 is lifted to remove the locking member 76 from the locking shaft 78 so that the locking is released, and after the release, the upper section of the device is locked into the lower section when the operating lever 70 is pushed hard downward.

Figure 14:
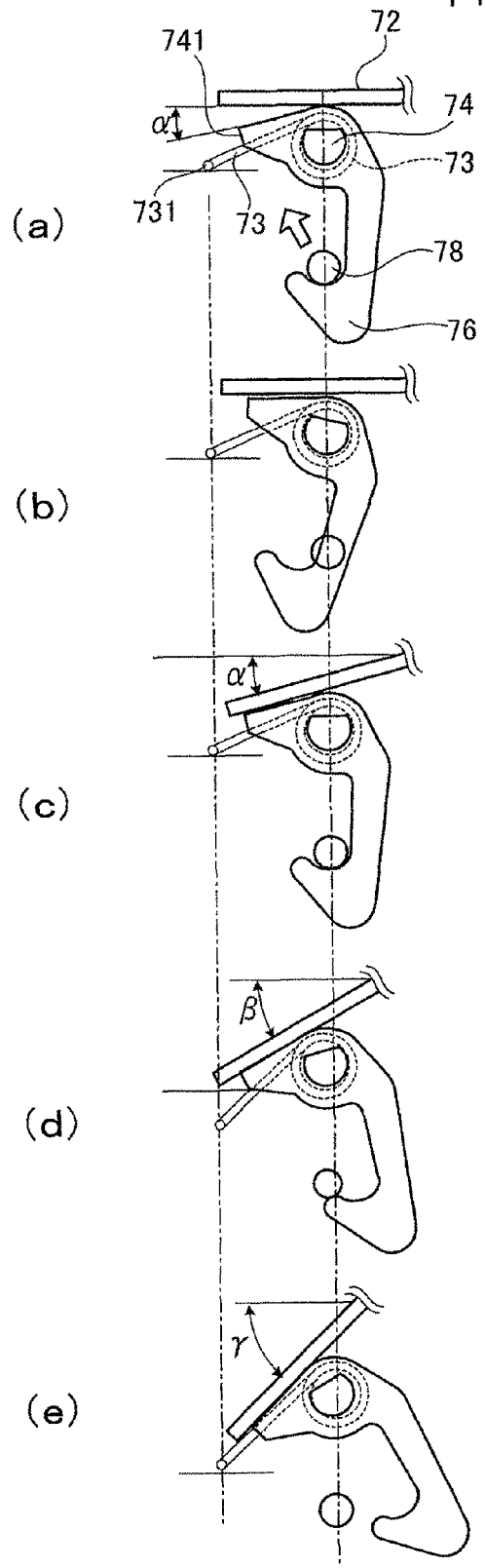
FIG. 14 is a perspective view of the locking system illustrated in FIG. 13 when viewed from a side.

FIG. 14 is a perspective view of the locking system illustrated in FIG. 13 when viewed from a side.

FIG. 14 illustrates movements of the pressure plate 72, the torsion spring 73, the penetrating shaft 74 and the locking member 76, in response to an operation of the operating lever 70. Incidentally, the penetrating shaft 74 has a part exposing on the outer side of the upper frame 75 and shaped like a semicolumn. On the inner side of the upper frame 75 however, the penetrating shaft 74 has a plate-like part 741 where a pressing force from the pressure plate 72 located above is exerted on the semicolumn. The plate-like part 741 is shaped to protrude while having a gap formed therein in a part along an axial direction. The torsion spring 73 is in a state of winding around the part shaped like the semicolumn of the penetrating shaft 74 by passing through the gap.

Part (a) of FIG. 14 illustrates a state of these members also depicted in FIG. 13 when the operating lever 70 is yet to be operated. Here, there is illustrated a state in which the other end 731 of the torsion spring 73 is supported on an inside bottom of the upper frame 75, and the locking member 76 is held by the locking shaft 78 with an urging force in the direction of an arrow illustrated in Part (a) of FIG. 14.

Further, Part (a) of FIG. 14 illustrates a state in which a gap with an angle $\alpha$ is formed between the plate-like part 741 of the penetrating shaft 74 and the pressure plate 72. This gap provides the pressure plate 72 with a so-called "play", i.e. a free movement between a horizontal state and a state of tilting by only the angle $\alpha$ in a counterclockwise direction.

Here, Part (b) of FIG. 14 illustrates a state of these members when the locking shaft 78, although actually provided, is absent. Here, there are illustrated the penetrating shaft 74 and the locking member 76 being rotated clockwise, shifting from the state illustrated in Part (a) of FIG. 14 to offset the urging force in the direction of the arrow illustrated in Part (a) of FIG. 14.

Part (c) of FIG. 14 illustrates a state in which the operating lever 70 is lifted counterclockwise by only the angle $\alpha$ and thereby the pressure plate 72 is tilted counterclockwise by only the angle $\alpha$. However, this is in the range of the "play" and thus, there is no change from the penetrating shaft 74 illustrated in Part (a) of FIG. 14.

In part (d) of FIG. 14, the operating lever 70 is lifted counterclockwise up to an angle $\beta$ ($\beta>\alpha$) against the urging force in the direction of the arrow illustrated in Part (a) of FIG. 14, so that the pressure plate 72 is tilted counterclockwise by only the angle $\beta$, and the plate-like member 741 receives the pressing force from the pressure plate 72. And, the penetrating shaft 74 rotates counterclockwise only by an angle ($\beta-\alpha$). As a result, the locking member 76 starts leaving the locking shaft 78.

In Part (e) of FIG. 14, the operating lever 70 is further lifted counterclockwise up to an angle $\gamma$ ($\gamma>\beta$), so that the pressure plate 72 is tilted counterclockwise by only the angle $\gamma$, and the plate-like member 741 receives the pressing force from the pressure plate 72. And, the penetrating shaft 74 rotates counterclockwise only by an angle ($\gamma-\alpha$). As a result, the locking member 76 is away from the locking shaft 78. Incidentally, a stopper 711 is provided at the bottom of the upper plate 71 to which the operating lever 70 is fixed, so that the pressure plate 72 is not allowed to rotate clockwise from a horizontal state by the operation of the operating lever 70 and is allowed to rotate only counterclockwise.

FIGS. 15 through 18 are diagrams that illustrate a flow of unlocking the decurler device.

Figure 15:
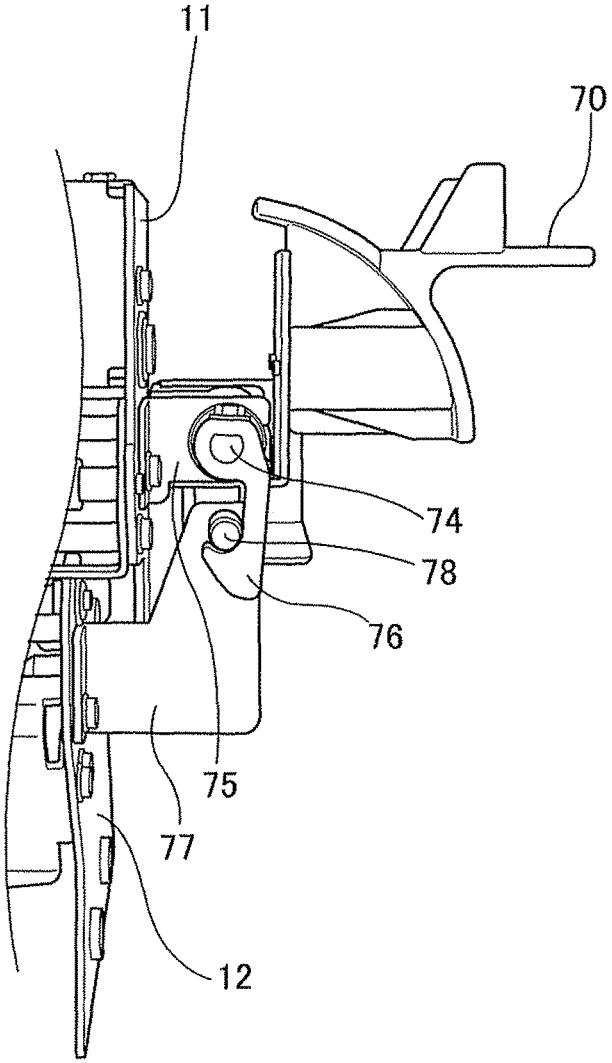
FIG. 15 illustrates a state in which an operating lever is yet to be operated.
Figure 16:
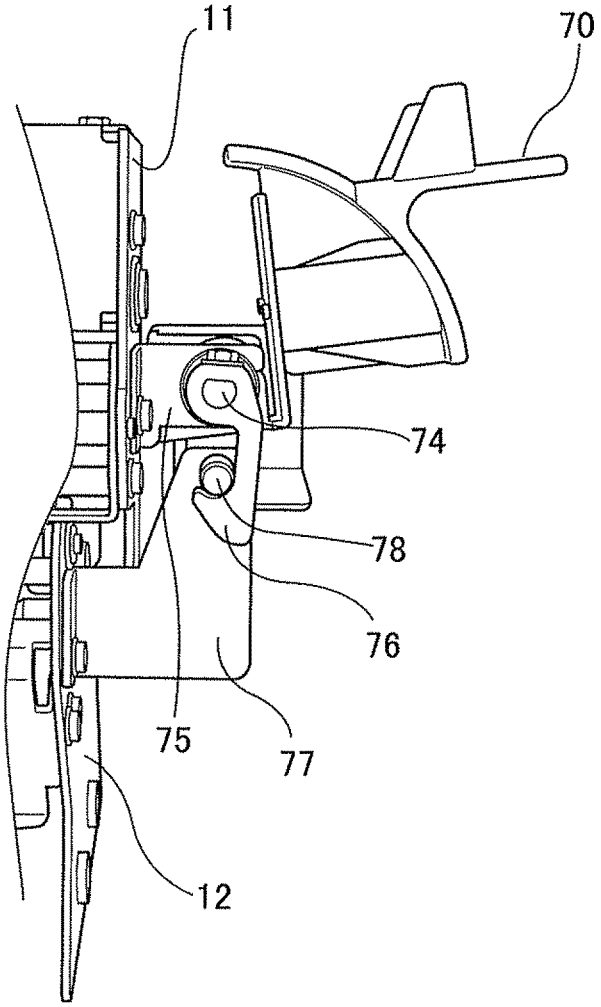
FIG. 16 illustrates a state in which the operating lever is slightly lifted.

FIG. 15 and FIG. 16 are side views of the decurler device 1. FIG. 15 illustrates a state in which the operating lever 70 is yet to be operated, and FIG. 16 illustrates a state in which the operating lever 70 is slightly lifted. In the state of FIG. 16, the pressure plate 72 is rotated counterclockwise less than the angle $\alpha$ with respect to the horizontal position. Thus, even when the operating lever 70 is operated in a range illustrated in FIG. 15 and FIG. 16, the unlocking movement is not initiated because the "play" is provided.

Figure 17:
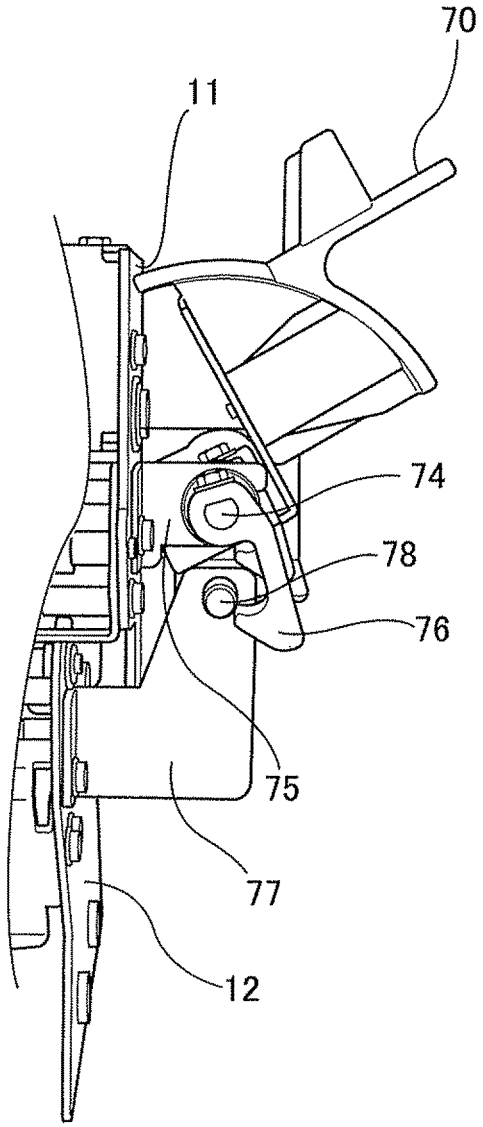
FIG. 17 illustrates a state in which the operating lever is lifted further upward than FIG. 16.

FIG. 17 illustrates a state in which the operating lever 70 is lifted further upward than FIG. 16, resulting in the state illustrated in Part (d) of FIG. 14. In other words, FIG. 17 illustrates a state in which the pressure plate 72 is rotated counterclockwise an angle equal to or larger than the angle $\alpha$ with respect to the horizontal position, so that the unlocking is initiated by the operation of the operating lever 70.

Figure 18:
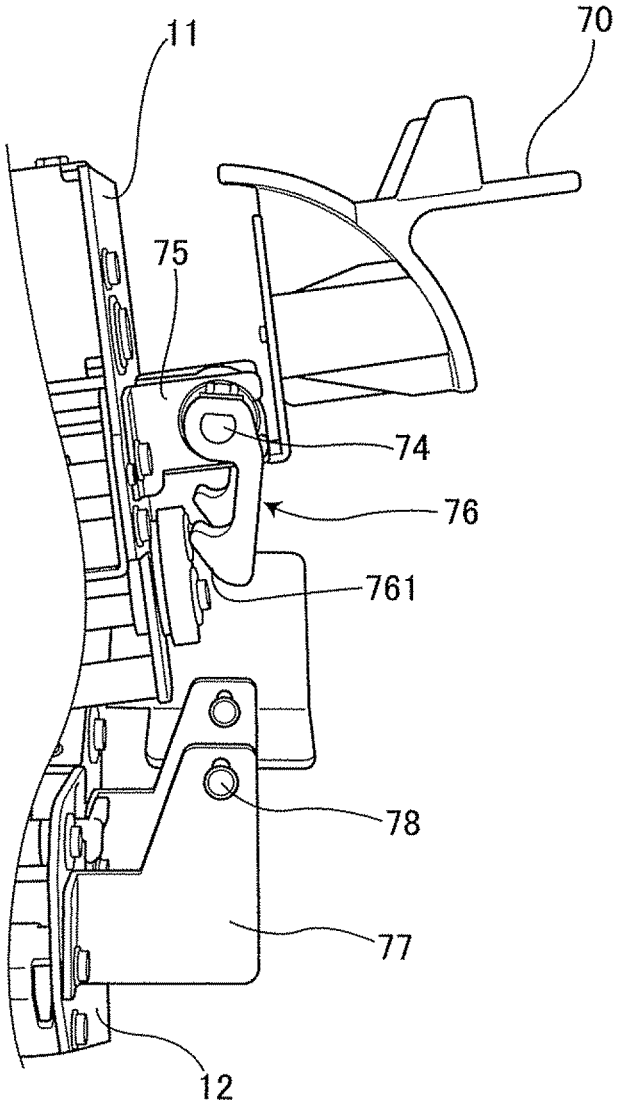
FIG. 18 illustrates a state in which the operating lever is lifted and then released.

FIG. 18 illustrates, as depicted in Part (d) of FIG. 14, the locking member 76 is kept away from the locking shaft 78, and the operating lever 70 is further lifted and then released. Incidentally, although illustration is omitted, when the operating lever 70 is pressed in the state illustrated in FIG. 18, the posture of the penetrating shaft 74 moves downward while maintaining the state depicted in Part (b) of FIG. 14. Then, the tip of the locking member 76 collides with the locking shaft 78 for a moment, but afterwards, the locking shaft 78 starts sliding along a tapered part 761 provided at the tip. Upon finishing sliding along the tapered part 761, the locking shaft 78 enters the state illustrated in Part (a) of FIG. 14 again.

Figure 19:
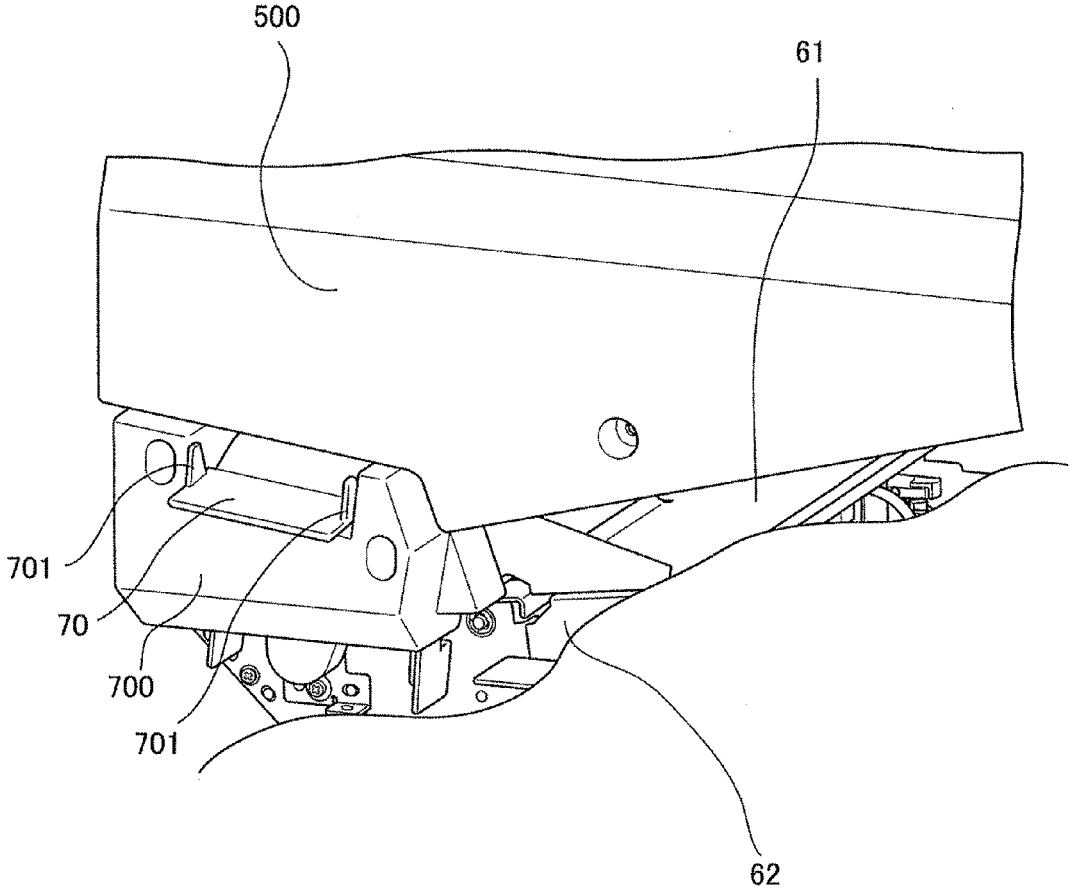
FIG. 19 is a diagram that illustrates a state in which the decurler device is locked and housed in the main-unit housing.

FIG. 19 is a diagram that illustrates a state in which the decurler device is locked and housed in the main-unit housing.

FIG. 19 illustrates a state in which a convex portion 701 standing while facing a front frame 500 of the main-unit housing is provided on the top surface of the operating lever 70 of the decurler device 1.

This convex portion 701 is a stopper for preventing occurrence of such an event that the operating lever 70 of the decurler device 1 accommodated in the main-unit housing in the locked state is lifted beyond the "play" by mistake, causing the unlocking in the main-unit housing. In other words, before the operating lever 70 is lifted to an extent of causing the unlocking, the convex portion 701 hits the front frame 500 of the main-unit housing, thereby preventing the unlocking in the main-unit housing. The operating lever 70 is an example of the operating member. Incidentally, a cover 700 is provided over the locking system 7.

Figure 20:
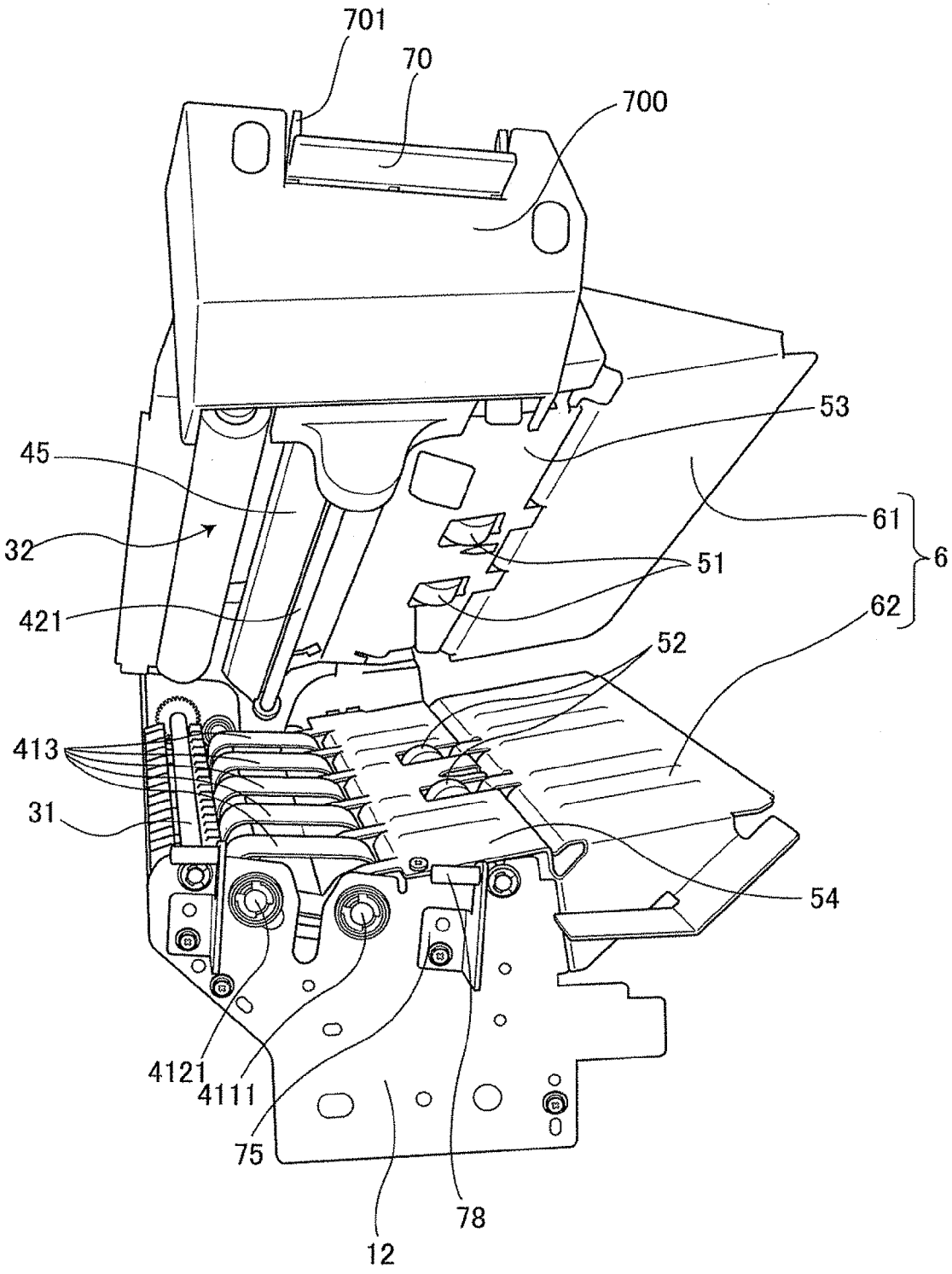
FIG. 20 is an external perspective view of the decurler device in which the upper section is released from the lower section.

FIG. 20 is an external perspective view of the decurler device in which the upper section is released from the lower section.

FIG. 20 illustrates, sequentially from the left in the lower section, the conveyance drive shaft 31 of the roll decurler section 3, the plural endless belts 413 of the belt decurler section 4 that are aligned in a direction crossing the sheet conveyance direction, a lower output guide 54, the lower rotating rolls 52 and the lower chute 62. FIG. 20 further illustrates, sequentially from the left in the upper section, the correction roll 32, the paper conveyance guide 45, the pressing roll 421, an upper output guide 53, the upper rotating rolls 51 and the upper chute 61. Incidentally, the decurler device 1 includes a torsion spring that produces an urging force in a direction of lifting the upper section when the locking is released.

In the decurler device 1, the roll decurler section 3 having the pair of rolls sandwiching the conveyed paper sheet is disposed upstream in the sheet conveyance direction, and the belt decurler section 4 having the plural endless belts 413 intermittently aligned in the direction crossing the sheet conveyance direction is disposed downstream. The reason is as follows. Immediately after arriving at the decurler device 1 upon passing through the cooling device 740, the surface of the paper sheet is yet to be completely cooled. Therefore, when the paper sheet yet to be completely cooled is conveyed while being sandwiched by members in which a part touching the surface of the payer sheet and a part not touching the surface of the payer sheet are mixed, a difference in luster is produced on the surface of the paper sheet. Therefore, in this decurler device 1, the roll decurler section 3 having the pair of rolls touching the entire surface of the paper sheet is disposed at a position closer to the cooling device 740, where the surface of the paper sheet is yet to be completely cooled.

Figure 21:
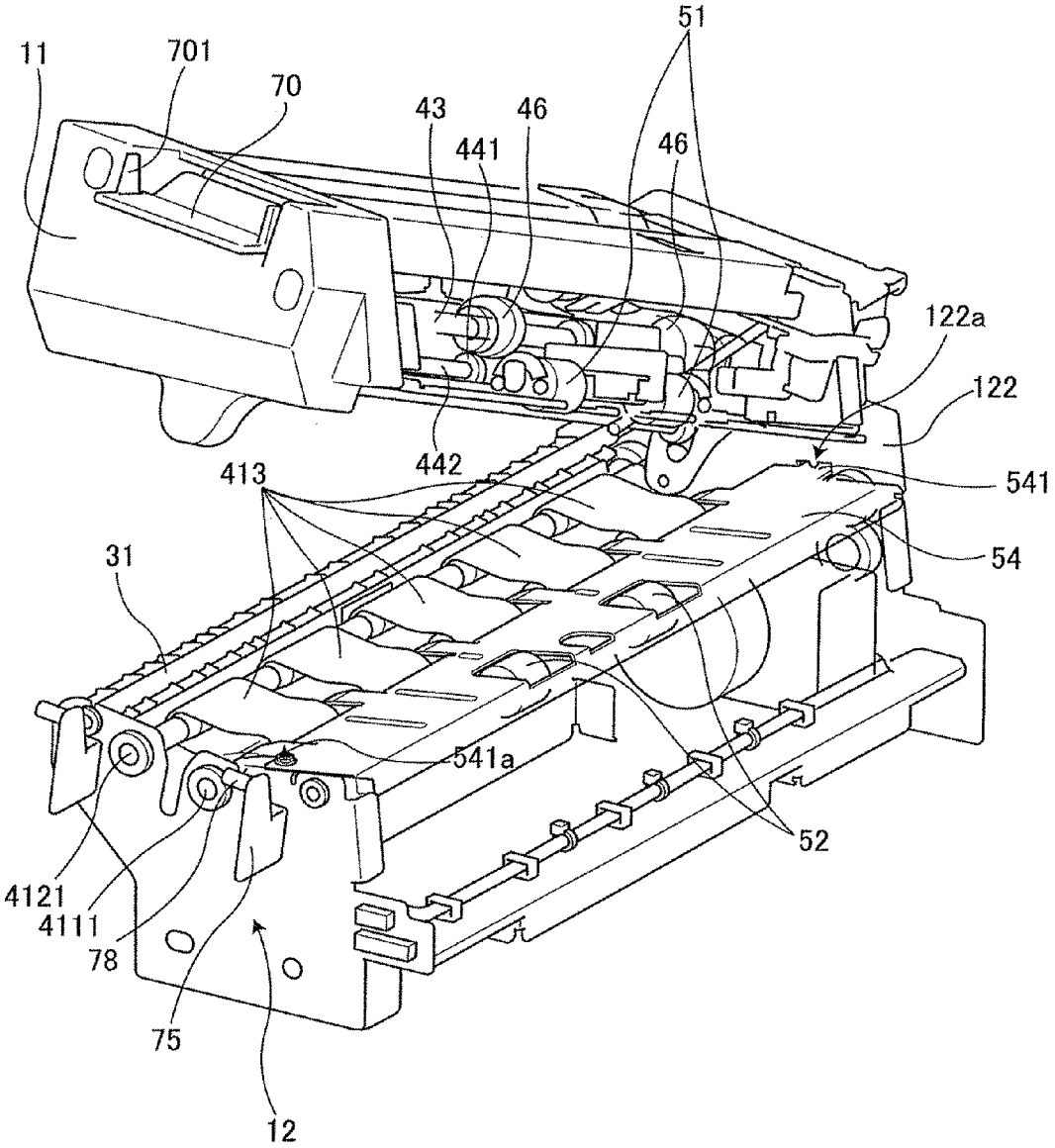
FIG. 21 is a diagram that illustrates how to attach a lower output guide.

FIG. 21 is a diagram that illustrates how to attach the lower output guide.

FIG. 21 illustrates a state in which a projection 541 provided at one end of the lower output guide 54 is engaged in a hole 122*a* formed in a rear plate 122 provided on a rear side of the lower housing 12, and a screw is inserted into a screw hole 541*a* formed at the other end of the lower output guide 54.

When the lower output guide 54 is thus configured, work in attaching the lower output guide 54 is saved in the decurler device.

Further, FIG. 21 illustrates a state in which the upper chute 61 and the lower chute 62 are removed from the decurler device 1 illustrated in FIG. 20. Two types of the upper chute 61 and the lower chute 62, i.e. a chute made of metal and a chute made of resin, are prepared and thus, the upper chute 61 and the lower chute 62 are replaceable depending on the paper sheet to be used.

However, the chute made of metal is heavier than the chute made of resin. For this reason, in a case where the torsion spring that produces the urging force in the direction of lifting the upper section upon unlocking is employed to be suitable for the chute made of metal, when this chute made of metal is replaced later with the chute made of resin, the force to release the upper section becomes too strong, placing a burden on a part where the upper section and the lower section of the device are coupled to each other. On the other hand, in a case where the torsion spring is employed to be suitable for the chute made of resin, there is a possibility that when this chute made of resin is replaced later by the chute made of metal, the force to release the upper section becomes insufficient, causing an inconvenience. Therefore, in this decurler device 1, an effort is made to ensure a stable urging force when either chute is used.

Figure 22:
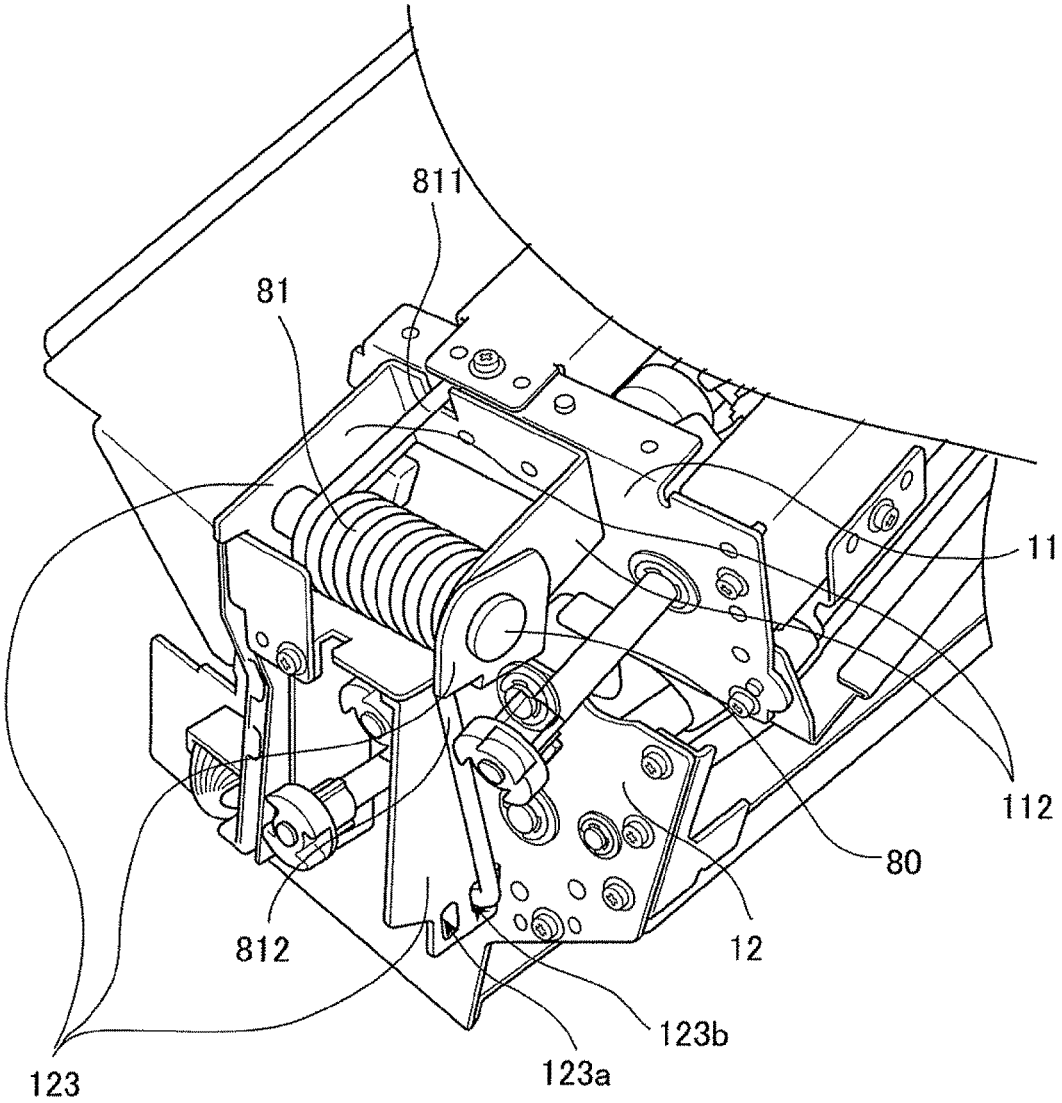
FIG. 22 is a diagram that illustrates the part where the upper section and the lower section of the decurler device are coupled to each other.

FIG. 22 is a diagram that illustrates the part where the upper section and the lower section of the decurler device are coupled to each other.

FIG. 22 illustrates the part where the upper section and the lower section of the decurler device 1 are coupled to each other. Here, there are illustrated an upper bearing section 112 attached to the upper housing 11, a lower bearing section 123 attached to the lower housing 12, a linking shaft 80 that links the upper bearing section 112 and the lower bearing section 123 by passing through these sections. One end 811 of the torsion spring 81 is connected to the upper housing 11, and the other end 812 is engaged in either a first engagement hole 123*a* or a second engagement hole 123*b* formed in the lower bearing section 123. This lower bearing section 123 is an example of the attachment section, and the torsion spring 81 is an example of the elastic member and also an example of the toggle spring.

Because the one end 811 of the torsion spring 81 is connected to the upper housing 11 and the other end 812 is engaged in either the first engagement hole 123*a* or the second engagement hole 123*b* of the lower bearing section 123, an urging force resisting the motion to close the upper section is produced in the torsion spring 81. In the decurler device 1, at the time of unlocking, the upper section is lifted to some extent by this urging force produced in the torsion spring 81 in the locked state.

FIG. 22 illustrates a state in which the other end 812 of the torsion spring 81 is engaged in the second engagement hole 123*b* on the right side in FIG. 22. In this case, the urging force resisting the motion to close the upper section is larger than that in the case in which the other end 812 is engaged in the first engagement hole 123. Therefore, the other end 812 is engaged in the first engagement hole 123*a* when the chute made of resin is used, and the other end 812 is engaged in the second engagement hole 123*b* when the chute made of metal is used, so that when the replacing chute is either type, the force to lift the upper section is produced to some extent.

Figure 23:
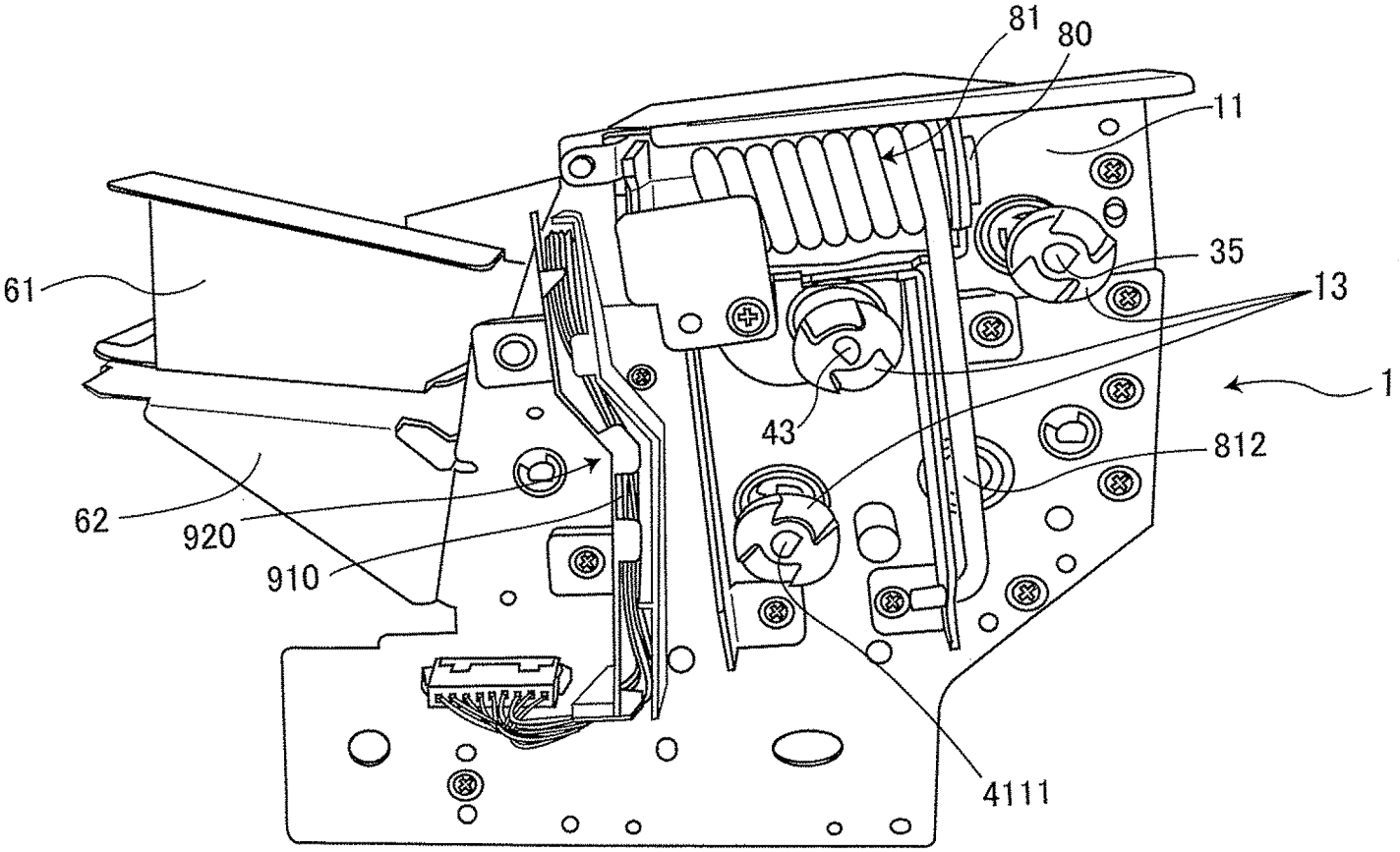
FIG. 23 is a diagram that illustrates a cover of a harness that links the upper section and the lower section.

FIG. 23 is a diagram that illustrates a cover of a harness that links the upper section and the lower section.

In the decurler device 1, a harness 910 for transmitting a signal from various sensors disposed in the upper section to the lower section is arranged on the side where there is provided the linking shaft linking the lower section and the upper section and also illustrated in FIG. 22. In FIG. 23, a harness cover 920 covering a bundle of the harness 910 arranged on the linking shaft side is screwed.

In this way, since the harness 910 linking the upper section and the lower section is covered by the harness cover 920 on the linking shaft side where the upper section and the lower section are coupled to each other, the length of the harness 910 is a minimum and the harness 910 is prevented from spreading.

Incidentally, the decurler device 1 is housed in the main-unit housing after the upper section and the lower section are locked. The decurler device 1 is devised to weaken a resistance produced by the contact between the correction roll 32 and the conveyance drive shaft 31 when the upper section is closed.

Figure 24:
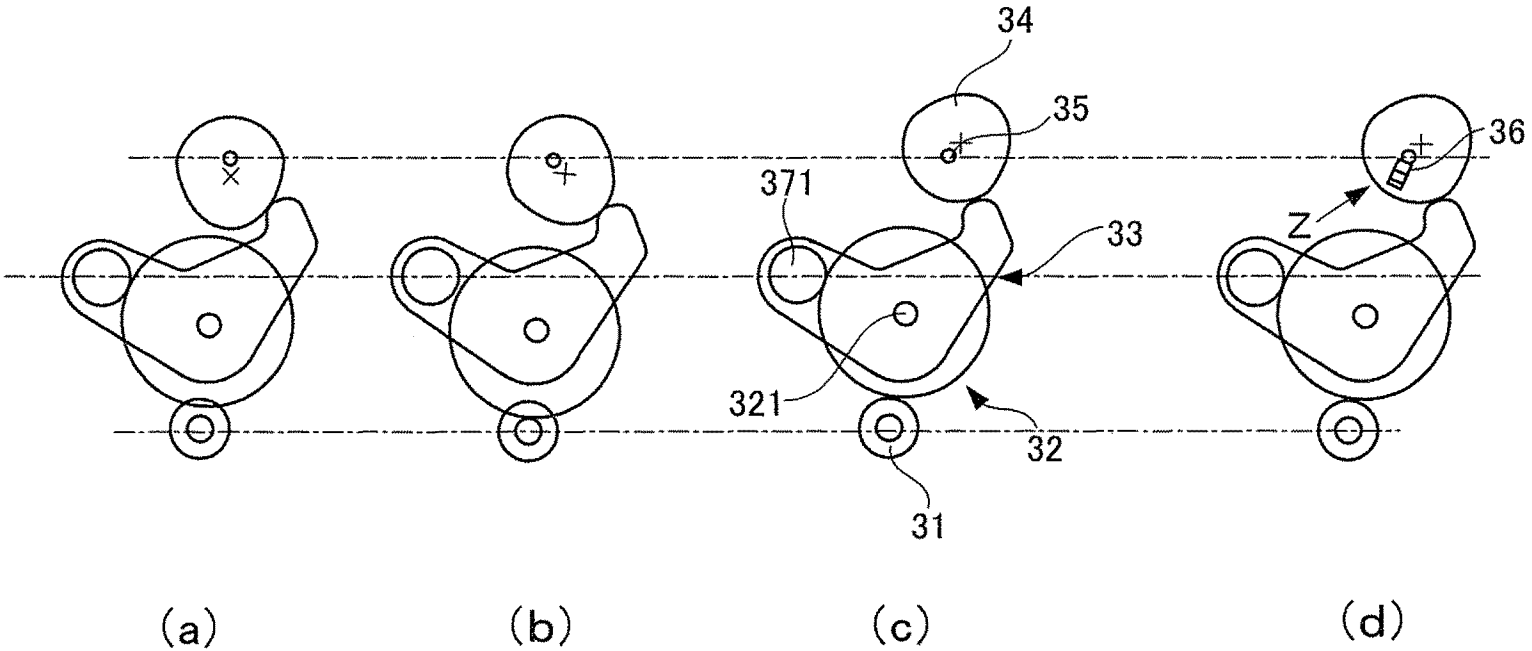
FIG. 24 is a schematic diagram of the roll decurler section.

FIG. 24 is a schematic diagram of the roll decurler section.

As described with reference to FIG. 4, when the decurler device 1 is drawn from the main-unit housing, the connection between the coupler 13 attached to the end of the first rotating shaft 35 of the roll decurler section 3 and the drive shaft of the stepping motor SM1 provided in the main unit side is released. Further, when the upper section of the decurler device 1 is opened, if no effort is made, the first rotating shaft 35 illustrated in FIG. 2 and FIG. 3 is rotated by torque produced in the first off-center cam 34 fixed to both ends of the first rotating shaft 35, and the first off-center cam 34 is in the posture in which a center of gravity of the first off-center cam 34 is located at a lower point in a vertical direction passing through the center of the first rotating shaft 35.

Part (a) of FIG. 24 illustrates a posture of the first off-center cam 34 after the upper section is opened. Part (b) of FIG. 24 illustrates a state in which the amount of biting of the conveyance drive shaft 31 into the correction roll 32 in the roll decurler section 3 is a maximum. Part (c) of FIG. 24 illustrates a state in which the amount of biting of the conveyance drive shaft 31 into the correction roll 32 in the roll decurler section 3 is a minimum. In the posture of the first off-center cam 34 illustrated in Part (a) of FIG. 24, the amount of biting of the conveyance drive shaft 31 into the correction roll 32 is smaller than that in the posture illustrated in Part (b) of FIG. 24, but slightly larger than that in the posture illustrated in Part (c) of FIG. 24. Therefore, it is not convenient to close and lock the upper section while leaving the first off-center cam 34 in the posture illustrated in Part (a) of FIG. 24, since the resistance is strong.

Thus, in the decurler device 1, this resistance is weakened by attaching a weight 36 to the first rotating shaft 35 as described below.

Figure 25:
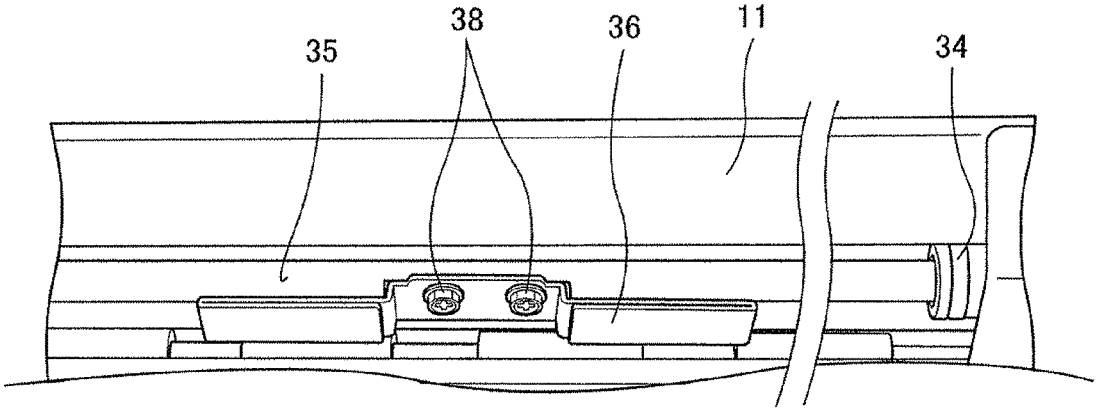
FIG. 25 is a diagram that illustrates a state in which a weight attached to a first rotating shaft is viewed from the direction indicated by an arrow Z illustrated in Part (d) of FIG. 24.

FIG. 25 is a diagram that illustrates a state in which the weight attached to the first rotating shaft is viewed from the direction indicated by an arrow Z illustrated in Part (d) of FIG. 24.

FIG. 25 illustrates the weight 36 screwed on a part of the circumferential surface of the first rotating shaft 35. The weight 36 is provided to enable, when the upper section is opened, the first off-center cam 34 to be in the posture illustrated in Part (c) of FIG. 24, in which the amount of biting of the conveyance drive shaft 31 into the correction roll 32 is a minimum. The position and the heaviness of the weight 36 illustrated in Part (d) of FIG. 24 are determined to produce torque that offsets the torque produced in the first off-center cam 34 taking the posture illustrated in Part (c) of FIG. 24. By making such an effort, in the decurler device 1, the resistance caused due to the contact between the correction roll 32 and the conveyance drive shaft 31 is weakened when the upper section is closed.

Figure 26:
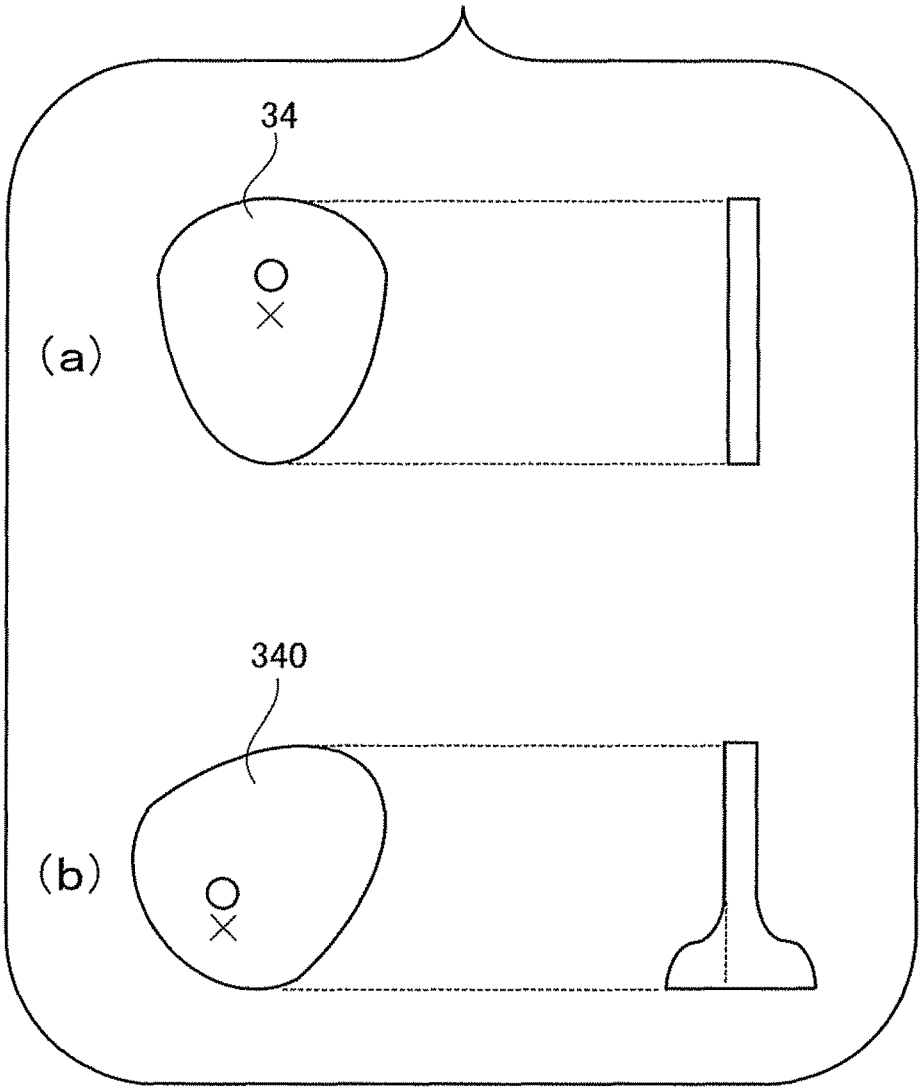
FIG. 26 is a diagram that illustrates a modification of the exemplary embodiment illustrated in FIG. 24.

FIG. 26 is a diagram that illustrates a modification of the exemplary embodiment illustrated in FIG. 24.

Part (a) of FIG. 26 illustrates a front view and a side view of the first off-center cam 34 illustrated in FIG. 24. Further, in Part (a) of FIG. 26, a center of rotation of the first off-center cam 34 is indicated by "o" and a center of gravity is indicated by "x".

Part (b) of FIG. 26 illustrates a front view and a side view of an off-center cam 340 partially thicker as compared to the first off-center cam 34 illustrated in Part (a) of FIG. 26. When viewed from the front, the first off-center cam 34 and the off-center cam 340 are equal in size and shape. Further, in Part (b) of FIG. 26, a center of rotation of the off-center cam 340 is indicated by "o" and a center of gravity is indicated by "x".

The off-center cam 340 is made partially thicker as compared to the first off-center cam 34, so that when the off-center cam 340 is in the posture as illustrated in Part (c) of FIG. 24 in which the amount of biting of the conveyance drive shaft 31 into the correction roll 32 is the minimum, the center of gravity is located at a lower position in the vertical direction of the arbor.

When the upper section is opened, the off-center cam 340 is in the position in which the amount of biting of the conveyance drive shaft 31 into the correction roll 32 is the minimum. Therefore, in the decurler device 1, by using the off-center cam 340 in place of the weight 36 illustrated in Part (d) of FIG. 24, the resistance produced by the contact between the correction roll 32 and the conveyance drive shaft 31 is weakened when the upper section is closed. This concludes the description of an effort to weaken the resistance produced by the contact between the correction roll 32 and the conveyance drive shaft 31 when the upper section is closed.

Incidentally, the correction roll 32 used in the roll decurler section 3 of the decurler device 1 is a consumable component made of a material softer than that of the conveyance drive shaft 35 and thus is replaceable.

However, the correction roll 32 is a rotatably supported member, and the first rotating shaft 35 and the like are disposed above the correction roll 32 and therefore, when, for example, the arbor of the correction roll 32 is supported by the frontward housing part and the rearward housing part of the upper housing 11 as illustrated in FIG. 2, labor and time are consumed in replacement. Thus, in this decurler device 1, the labor and time in replacement are saved by making an effort as described below.

Figure 27:
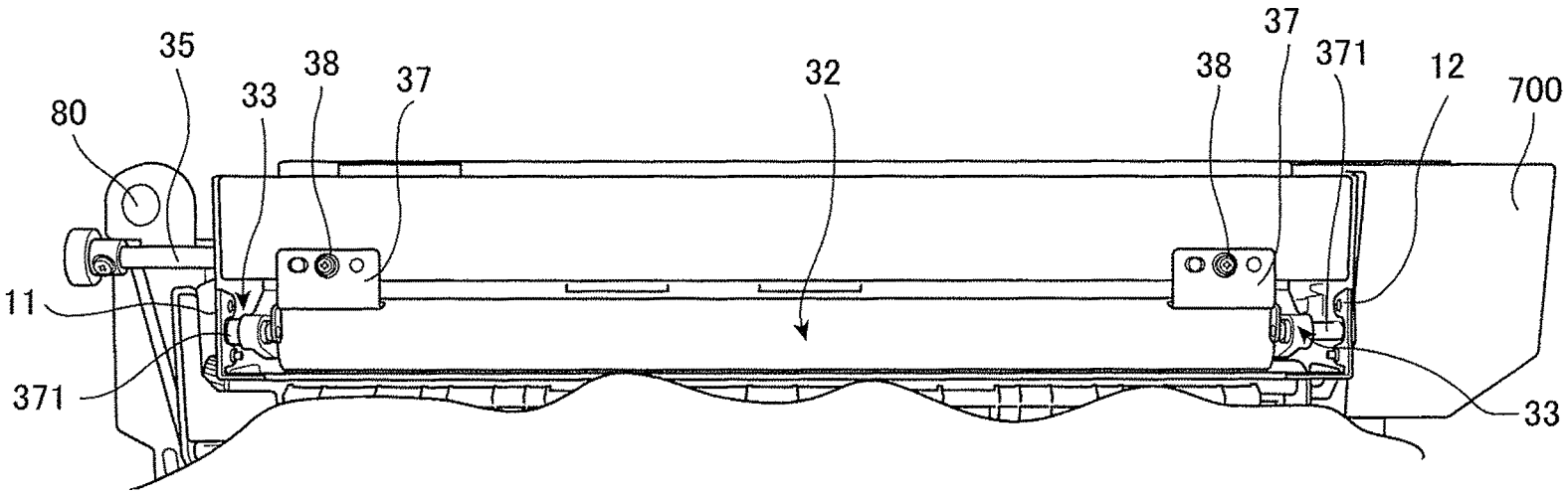
FIG. 27 is a side view of the decurler device when viewed from a cooling device side.

FIG. 27 is a side view of the decurler device when viewed from the cooling device side.

FIG. 27 illustrates the first holding member 33 that supports the correction roll 32 while allowing correction roll 32 to be rotatable. FIG. 27 further illustrates the first support member 37 that has the penetrating shaft 371 passing through the through hole 332 in the first holding member 33 and is screwed on the upper housing 11.

Figure 28:
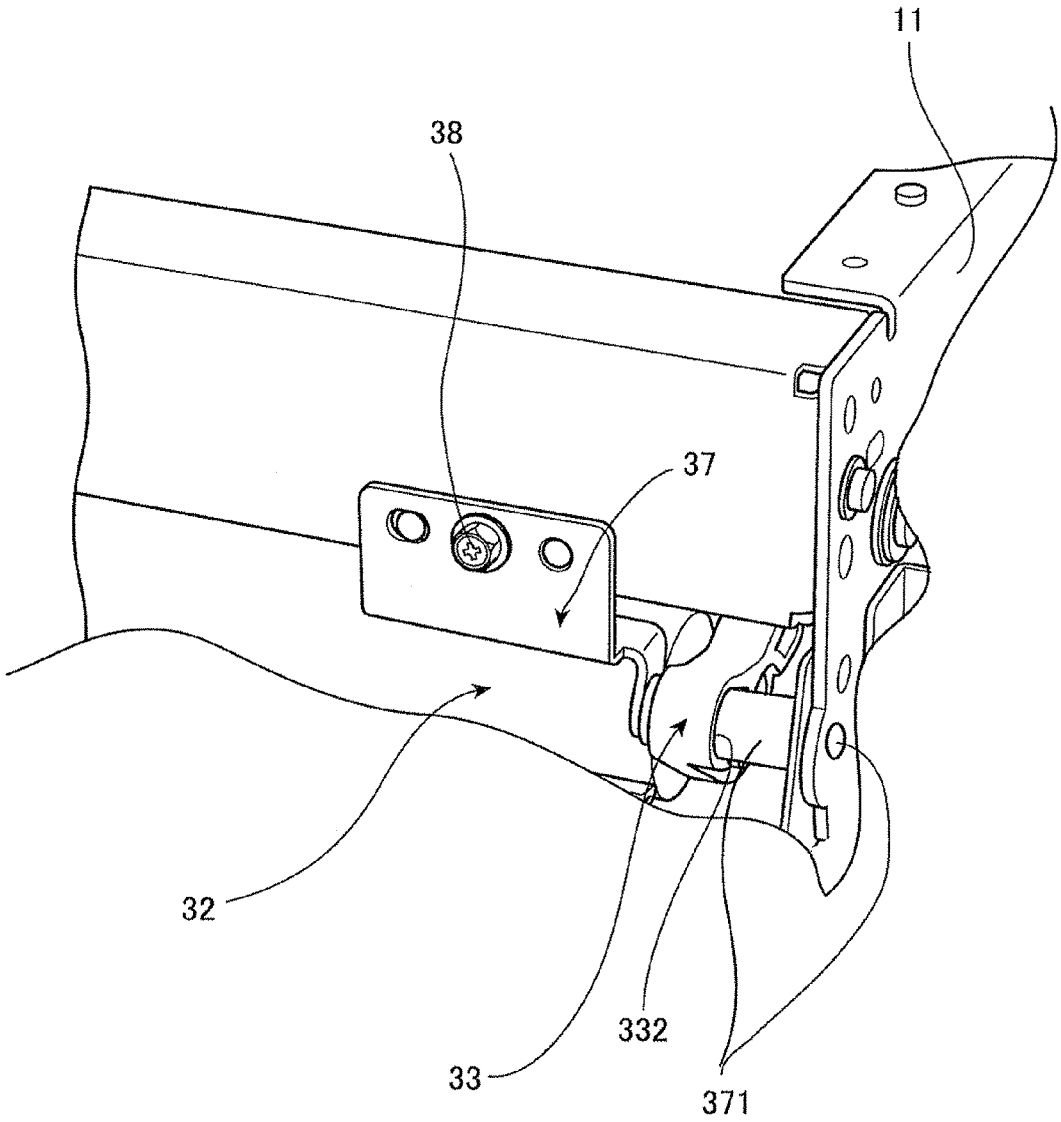
FIG. 28 is an enlarged view of a first support member illustrated in FIG. 27.

FIG. 28 is an enlarged view of the first support member illustrated in FIG. 27.

FIG. 28 illustrates a state in which the tip of the penetrating shaft 371, which is provided in the first support member 37 supporting the correction roll 32 and passes through the through hole 332 formed in the first holding member 33, is supported by the upper housing 11. Incidentally, although illustration on the other side is omitted, the other tip of the penetrating shaft 371 is similarly supported by the upper housing 11 on the other side. The first holding member 33 is an example of the bearing member, and the first support member 37 is an example of the holding member.

Figure 29:
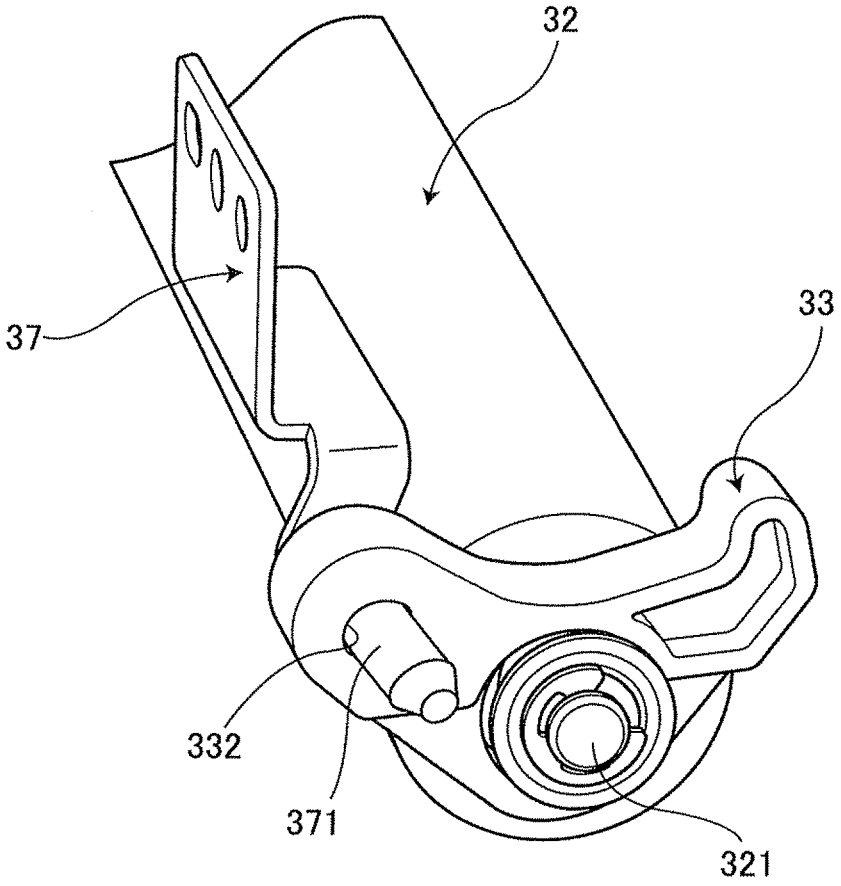
FIG. 29 is an external perspective view of a correction roll supported by the first support member.

FIG. 29 is an external perspective view of the correction roll supported by the first support member.

According to the structure illustrated in FIG. 29, the arbor 321 of the correction roll 32 is not directly held by the upper housing 11, and the penetrating shaft 371 passing through the through hole 332 formed in the first member 33 is directly held by the upper housing 11.

Figure 30:
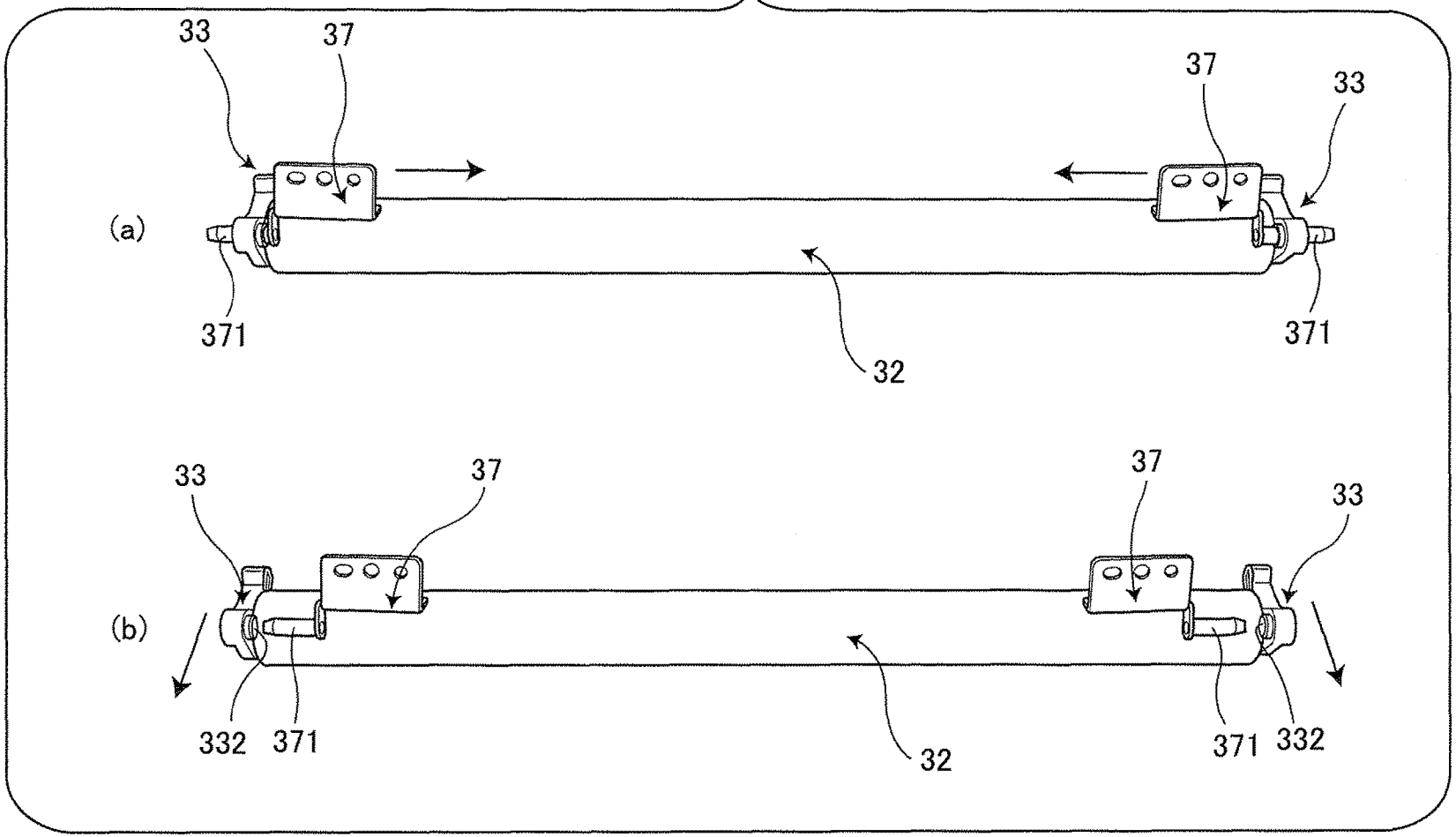
FIG. 30 is a diagram that illustrates how to replace the correction roll.

FIG. 30 is a diagram that illustrates how to replace the correction roll.

Part (a) of FIG. 30 illustrates a state in which the screw 38 is removed from the upper housing 11.

Part (b) of FIG. 30 illustrates a state in which by taking out the penetrating shaft 371 from the through hole, the correction roll 32, the first holding member 33 and the first support member 37 are released from the connection with the upper housing 11, and the correction roll 32 is drawn out in the direction of arrows. This makes the replacement of the correction roll 32 in the decurler device 1 easy.

Incidentally, in the exemplary embodiment, the tandem type of color printer is used as an example of the image forming device. However, the image forming device is not limited to this example and may be a monochrome dedicated printer having no intermediate transfer belt.

Further, in the exemplary embodiment, the printer is used as an example of the image forming device. However, the image forming device is not limited to this example and may be a copier or a facsimile.

Furthermore, in the exemplary embodiment, the combination of the charging device and the exposure device is used as an example of the image forming section. However, the image forming section is not limited to this example and may be an element that causes a toner to directly adhere to a position corresponding to an image on the image retainer by aiming that position.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A medium correcting device comprising:

a first rotating body that has a circumferential surface moving circumferentially;

a second rotating body that has a circumferential surface softer than the circumferential surface of the first rotating body and moving circumferentially as the circumferential surface of the first rotating body moves circumferentially while the circumferential surface of the second rotating body and the circumferential surface of the first rotating body press each other, the second rotating body and the first rotating body holding a recording medium passing in between;

a first holding body that holds the first rotating body;

a second holding body that holds the second rotating body, is detachably coupled to the first holding body, and becomes, when being coupled to the first holding body, a coupled body into which the first rotating body and the second rotating body are incorporated and which is housed in a housing body;

a rotation shaft that is incorporated as a part of the coupled body and driven to rotate by a driving system of the housing body when the coupled body is housed in the housing body and the rotation shaft is connected to the driving system, the rotation shaft being disconnected and away from the driving system when the coupled body is removed from the housing body;

an off-center cam that is eccentrically fixed to the rotation shaft and that presses one of the first rotating body and the second rotating body against the other by an amount of pressing according to an angle of the off-center cam, the off-center cam providing a larger amount of pressing when the angle of the off-center cam is one in which an eccentric direction of the off-center cam is downward than when the angle of the off-center cam is one in which the eccentric direction of the off-center cam is upward; and a center-of-gravity correction section that is fixed to the rotation shaft and that has a center of gravity thereof at a position deviated from the rotation shaft in a direction opposite to the eccentric direction of the off-center cam, the center-of-gravity correction section having a mass sufficient to cause the off-center cam to come to a rest position, in which the eccentric direction of the off-center cam points upwardly thereby providing a smaller amount of pressing, when the rotation shaft is disconnected from the driving system.

2. The medium correcting device according to claim 1, wherein the first holding body and the second holding body are vertically coupled to each other, the rotation shaft and the off-center cam are incorporated into an upper holding member that is one of the first holding body and the second holding body, and the off-center cam presses down one of the first rotating body and the second rotating body, the one being held by the upper holding member.

3. An image forming device comprising:

an image forming section that forms an image on a surface of a recording medium;

a first rotating body that has a circumferential surface moving circumferentially;

a second rotating body that has a circumferential surface softer than the circumferential surface of the first rotating body and moving circumferentially as the circumferential surface of the first rotating body moves circumferentially while the circumferential surface of the second rotating body and the circumferential surface of the first rotating body press each other, the second rotating body and the first rotating body holding the recording medium passing in between and having the surface on which the image is formed by the image forming section;

a first holding body that holds the first rotating body;

a second holding body that holds the second rotating body, is detachably coupled to the first holding body, and becomes, when being coupled to the first holding body, a coupled body into which the first rotating body and the second rotating body are incorporated and which is housed in a housing body;

a rotation shaft that is incorporated as a part of the coupled body and driven to rotate by a driving system of the housing body when the coupled body is housed in the housing body and the rotation shaft is connected to the driving system, the rotation shaft being disconnected and away from the driving system when the coupled body is removed from the housing body;

an off-center cam that is eccentrically fixed to the rotation shaft and that presses one of the first rotating body and the second rotating body against the other by an amount of pressing according to an angle of the off-center cam, the off-center cam providing a larger amount of pressing when the angle of the off-center cam is on in which an eccentric direction of the off-center cam is downward than when the angle of the off-center cam is one in which the eccentric direction of the off-center cam is upward; and a center-of-gravity correction section that is fixed to the rotation shaft and that has a center of gravity thereof at a position deviated from the rotation shaft in a direction opposite to the eccentric direction of the off-center cam, the center-of-gravity correction section having a mass sufficient to cause the off-center cam to come to a rest position, in which the eccentric direction of the off-center cam points upwardly thereby providing a smaller amount of pressing, when the rotation shaft is disconnected from the driving system.

* * * * *